US011280149B2

(12) United States Patent
Greska

(10) Patent No.: US 11,280,149 B2
(45) Date of Patent: Mar. 22, 2022

(54) ADAPTER FOR WELLHEAD PRESSURE CONTROL EQUIPMENT

(71) Applicant: CACTUS WELLHEAD, LLC, Houston, TX (US)

(72) Inventor: Brenton J. Greska, Katy, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 0 days.

(21) Appl. No.: 16/810,576

(22) Filed: Mar. 5, 2020

(65) Prior Publication Data

US 2020/0284116 A1 Sep. 10, 2020

Related U.S. Application Data

(60) Provisional application No. 62/821,273, filed on Mar. 20, 2019, provisional application No. 62/815,275, filed on Mar. 7, 2019.

(51) Int. Cl.
*E21B 33/03* (2006.01)

(52) U.S. Cl.
CPC ..... *E21B 33/03* (2013.01)

(58) Field of Classification Search
CPC ..... E21B 17/01; E21B 17/085; E21B 33/06; E21B 33/03; E21B 33/038; E21B 17/0853
See application file for complete search history.

(56) References Cited

U.S. PATENT DOCUMENTS

| | | | | |
|---|---|---|---|---|
| 3,895,829 | A * | 7/1975 | Manson, Jr. | E21B 17/043 285/3 |
| 4,165,891 | A * | 8/1979 | Sullaway | E21B 17/085 285/18 |
| 5,848,646 | A * | 12/1998 | Huber | E21B 34/14 166/297 |
| 7,163,054 | B2 | 1/2007 | Adams | |
| 8,225,857 | B2 | 7/2012 | Yadav et al. | |
| 8,474,537 | B2 | 7/2013 | Voss et al. | |
| 8,720,574 | B2 * | 5/2014 | Cuiper | E21B 33/038 166/338 |
| 8,763,708 | B2 | 7/2014 | Travis et al. | |
| 8,919,448 | B2 * | 12/2014 | Dziekonski | E21B 17/017 166/345 |
| 9,051,787 | B2 | 1/2015 | Laurel et al. | |
| 9,267,335 | B2 | 2/2016 | Walker et al. | |

(Continued)

*Primary Examiner* — Taras P Bemko
*Assistant Examiner* — Jonathan Malikasim
(74) *Attorney, Agent, or Firm* — Ewing & Jones, PLLC

(57) ABSTRACT

An adapter for coupling wellhead pressure control equipment to wellhead mounted equipment, includes a breech pin and a breech lock base assembly. The breech pin includes a tubular breech pin body and a rotating breech ring. The rotating breech ring is coupled to and rotatable relative to the breech pin body. The rotating breech ring includes a breech ring body and one or more breech pin teeth extending radially outward from the breech ring body. The breech lock base assembly includes a tubular base assembly body. An upper end of the bore of the base assembly body defines an upper receiver. The breech lock base assembly includes a fixed retaining ring including one or more fixed breech teeth. The fixed breech teeth extend radially inward into the upper receiver. The fixed breech teeth are positioned to correspond with the spaces between the breech pin teeth.

20 Claims, 21 Drawing Sheets

(56) References Cited

U.S. PATENT DOCUMENTS

| | | | | |
|---|---|---|---|---|
| 9,670,745 | B1 | 1/2017 | Johansen et al. | |
| 9,644,443 | B1 | 5/2017 | Johansen et al. | |
| 9,725,978 | B2 | 8/2017 | Gilmore et al. | |
| 9,879,496 | B2 | 1/2018 | Johansen et al. | |
| 2016/0084021 | A1* | 3/2016 | Jewett | G01B 21/22 166/302 |

* cited by examiner

ADAPTER FOR WELLHEAD PRESSURE CONTROL EQUIPMENT

CROSS-REFERENCE TO RELATED APPLICATIONS

This application is a non-provisional application which claims priority from U.S. provisional application No. 62/815,275, filed Mar. 7, 2019, and from U.S. provisional application No. 62/821,273, filed Mar. 20, 2019, each of which is hereby incorporated by reference in the entirety.

TECHNICAL FIELD/FIELD OF THE DISCLOSURE

The present disclosure relates to the field of wellhead equipment.

BACKGROUND OF THE DISCLOSURE

This disclosure relates generally to the field of equipment used to secure wellhead pressure control or containing equipment to existing wellhead mounted equipment used in connection with wells for the production of hydrocarbons.

SUMMARY

The present disclosure provides for an adapter for coupling wellhead pressure control equipment to wellhead mounted equipment. The adapter may include a breech pin. The breech pin may include a breech pin body, the breech pin body being tubular. The breech pin may include a rotating breech ring coupled to the breech pin body and rotatable relative to the breech pin body. The rotating breech ring may include a breech ring body and one or more breech pin teeth extending radially outward from the breech ring body. The adapter may include a breech lock base assembly. The breech lock base assembly may include a base assembly body, the base assembly body being tubular. An upper end of the bore of the base assembly body may define an upper receiver. The breech lock base assembly may include a fixed retaining ring, the fixed retaining ring including one or more fixed breech teeth. The fixed breech teeth may extend radially inward into the upper receiver. The fixed breech teeth may be positioned to correspond with the spaces between the breech pin teeth.

The present disclosure also provides for a method. The method may include providing a breech pin. The breech pin may include a breech pin body, the breech pin body being tubular. The breech pin may include a rotating breech ring coupled to the breech pin body and rotatable relative to the breech pin body. The rotating breech ring may include a breech ring body and one or more breech pin teeth extending radially outward from the breech ring body. The method may include coupling a breech lock base assembly to a wellhead. The breech lock base assembly may include a base assembly body, the base assembly body being tubular. An upper end of the bore of the base assembly body may define an upper receiver. The breech lock base assembly may include a fixed retaining ring including one or more fixed breech teeth. The fixed breech teeth may extend radially inward into the upper receiver. The fixed breech teeth may be positioned to correspond with the spaces between the breech pin teeth. The method may include aligning the breech pin teeth with the spaces between the fixed breech teeth, inserting the breech pin into the upper receiver, and rotating the rotating breech ring such that one or more of the breech pin teeth are positioned below the fixed breech teeth.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
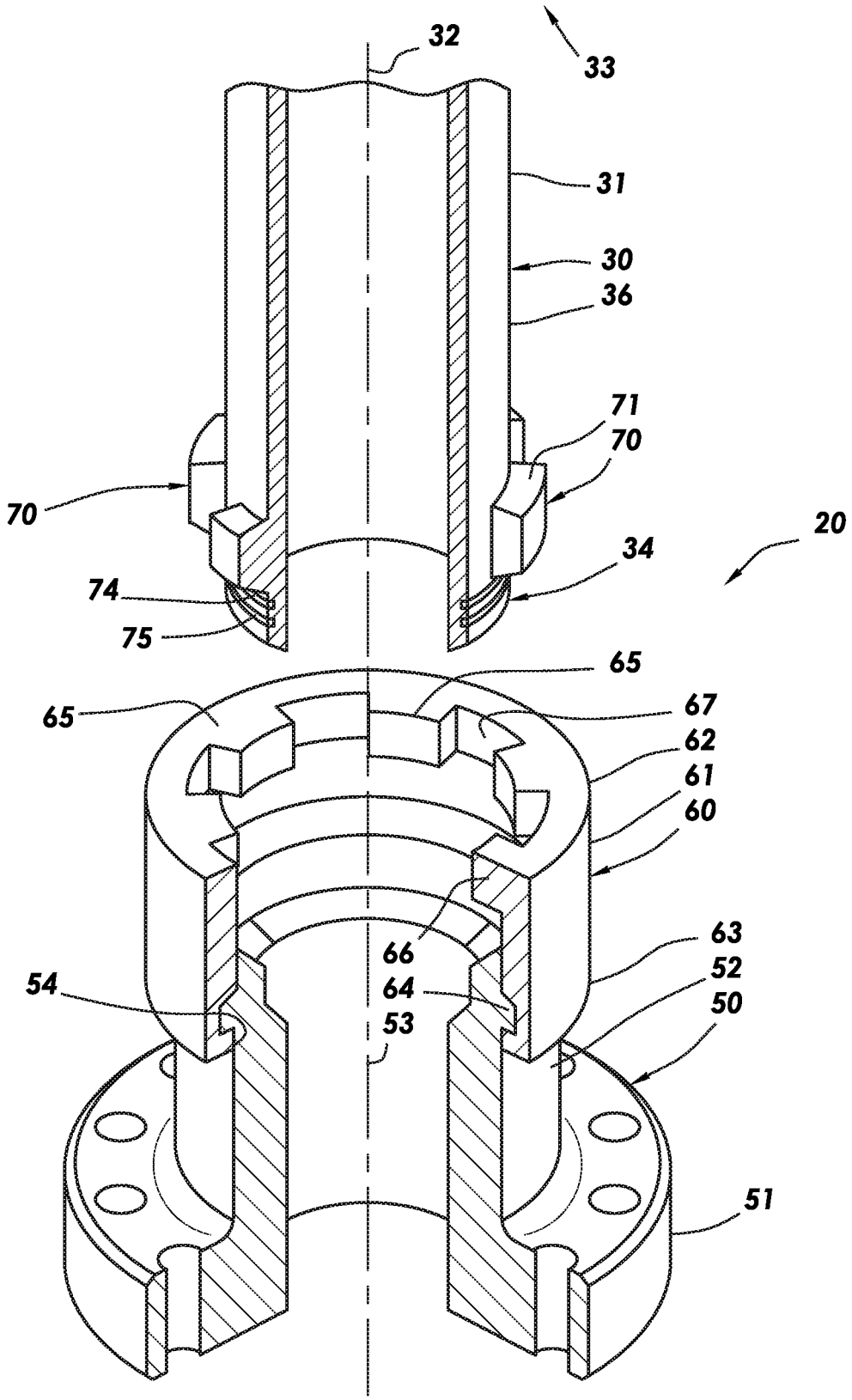
FIG. 1 is a perspective, partial cross-sectional view of an adapter consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
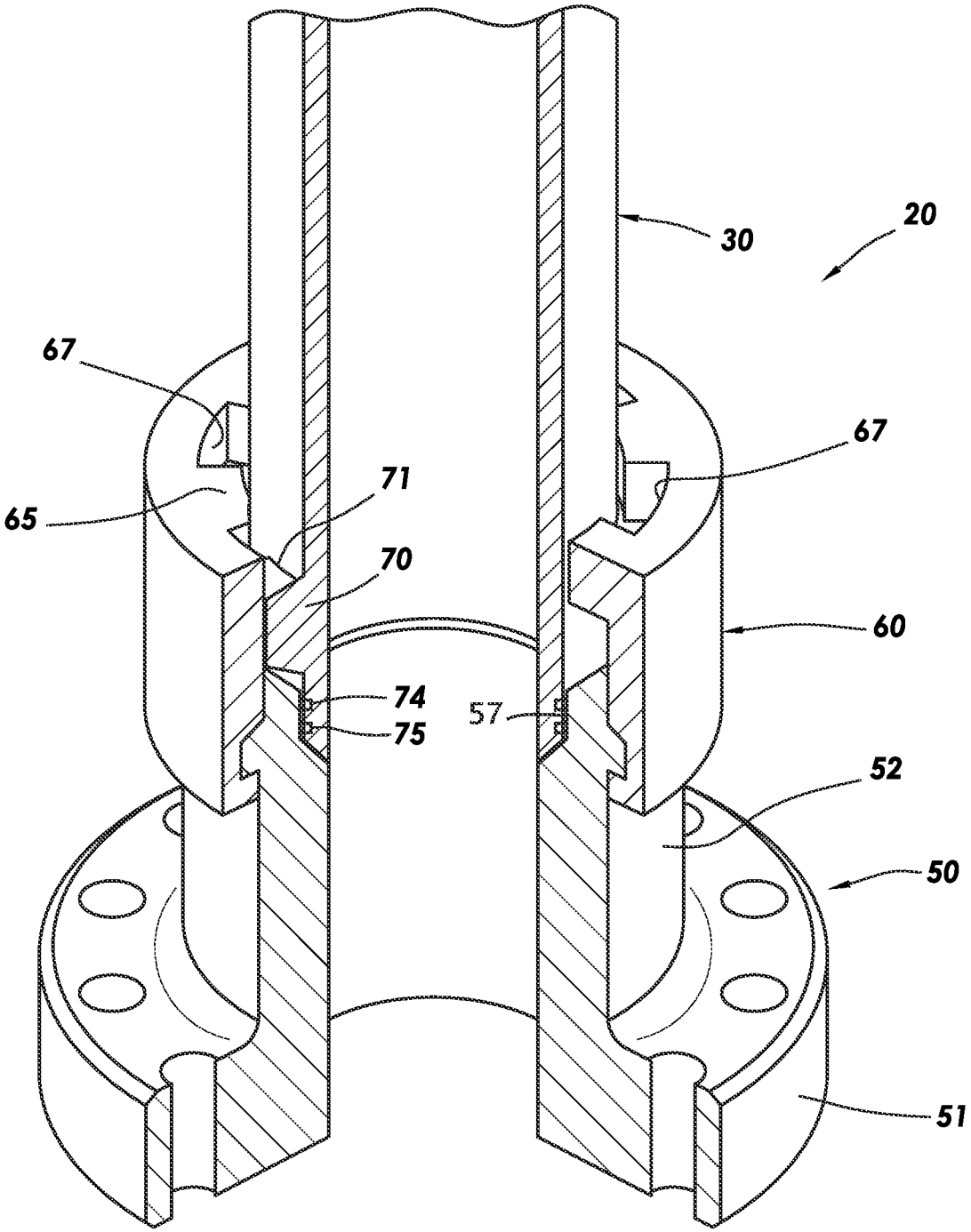
FIG. 2 is a perspective, partial cross-sectional view of the adapter of FIG. 1 in an unlocked configuration.
Figure 3:
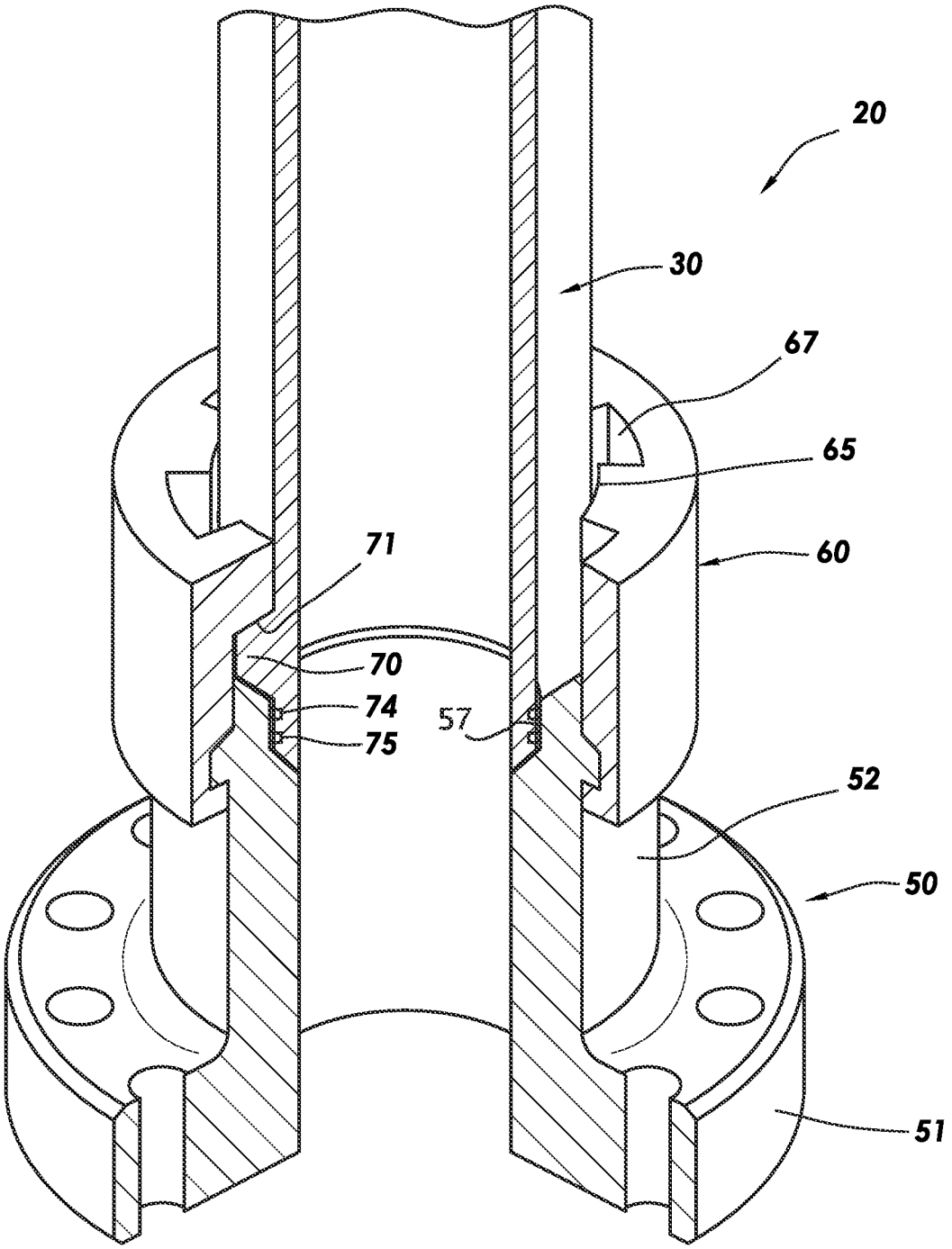
FIG. 3 is a perspective, partial cross-sectional view of the adapter of FIG. 1 in a locked configuration.
Figure 15:
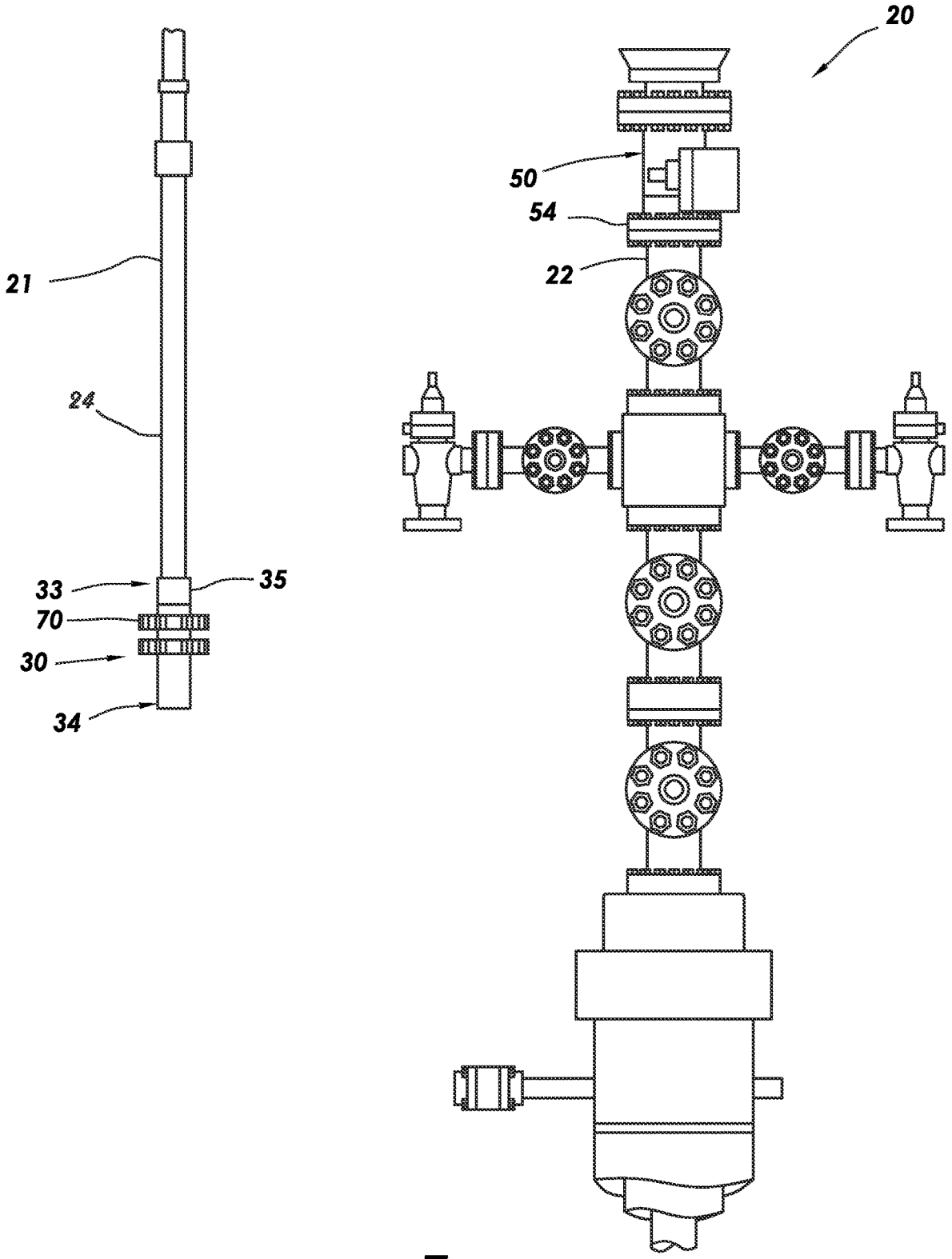
FIG. 15 is a perspective view of an adapter consistent with at least one embodiment of the present disclosure, mounted upon wellhead mounted equipment.

With reference to FIGS. 1-3 and 15, adapter 20 for coupling wellhead pressure control or containing equipment 21 (as shown in FIG. 15), such as, for example, a wireline blowout preventer or wireline lubricator 24 to wellhead mounted equipment 22, such as a frac tree (as shown in FIG. 15) is shown. In some embodiments, adapter 20, as shown in FIGS. 1-3, may include: a male sub member (hereinafter "breech pin 30"); a female base member (hereinafter "breech lock base assembly 50"); and rotatable locking ring 60. Breech pin 30 may include a tubular member (hereinafter "breech pin body 31") having longitudinal axis 32, upper end 33, and lower end 34. As shown in FIG. 15, upper end 33 of breech pin 30 may be secured to wellhead pressure control equipment 21, such as, for example and without limitation, wireline lubricator 24 as shown in FIG. 15. In FIG. 15, breech pin 30 is illustrated at a position prior to being inserted into breech lock base assembly 50. Breech pin 30 may be secured to wellhead equipment 21, such as, for example, a flanged connection or, as shown in FIG. 15, a threaded connection 35.

Still with reference to FIGS. 1-3 and 15, breech pin 30 may include two or more locking tabs (hereinafter "pin breech teeth 70") positioned upon outer surface 36 of breech pin body 31. In the embodiment shown in FIG. 1, pin breech teeth 70 are positioned adjacent lower end 34 of breech pin 30. In other embodiments, pin breech teeth 70 may be positioned at other locations on breech pin 30. In some embodiments, pin breech teeth 70 may be positioned on breech pin body 31. In certain non-limiting embodiments, pin breech teeth 70 may be radially spaced about outer surface 36 of breech pin body 31.

In some embodiments, breech lock base assembly 50 may be adapted to receive lower end 34 of breech pin 30 as shown in FIGS. 2 and 3. Breech lock base assembly 50 may include lower flange 51. Lower flange 51 may be secured to wellhead mounted equipment 22 including, for example and without limitation, a valve tree such as a frac tree. Breech lock base assembly 50 may also include an upwardly extending tubular member (hereinafter, "base assembly body 52"). In some embodiments, lower flange 51 may be integrally formed with base assembly body 52 or may be secured to base assembly body 52 by, for example and without limitation, welding. Breech pin 30 may include one or more seals 74, 75 positioned on breech pin body 31. In some embodiments, seals 74, 75 may be positioned at a location near lower end 34 of breech pin body 31. Seals 74, 75 may, in some embodiments, seal against interior surface 57 of base assembly body 52, as shown in FIGS. 2 and 3.

Rotatable locking ring 60 may be coupled to breech lock base assembly 50 such that rotatable locking ring 60 may rotate relative to breech lock base assembly 50. In some embodiments, locking ring 60 may include locking ring body 61. Locking ring body 61 may be tubular and may have upper end 62 and lower end 63. In some embodiments, lower end 63 may include internal flange 64 formed in interior bore of locking ring body 61. Internal flange 64 may, in some embodiments, engage exterior annular flange 54 formed on the exterior surface of base assembly body 52 of breech lock base assembly 50. Rotatable locking ring 60 may include a plurality of movable breech teeth 65, such as movable breech teeth located at or near upper end 62 of locking ring body 61. Movable breech teeth 65 may extend radially inward within locking ring body 61. In some embodiments, movable breech teeth 65 may be formed by forming a plurality of slots 67 in an internal annular flange 66 formed at an upper end 62 of locking ring body 61 as shown in FIG. 1. Radially spaced slots 67 may, in some embodiments, correspond in number and rotational location to pin breech teeth 70 of breech pin 30. When pin breech teeth 70 and slots 67 are aligned, defining an "unlocked" position of locking ring 60, lower end 34 of breech pin 30 may be lowered into breech lock base assembly 50 such that pin breech teeth 70 pass through slots 67 of locking ring 60 as shown in FIG. 2.

When pin breech teeth 70 of breech pin 30 engage the upper end of base assembly body 52 of breech lock base assembly 50, as shown in FIG. 2, breech pin 30 is not in a locked configuration with respect to breech lock base assembly 50, as there is no portion of movable breech teeth 65 of locking ring 60 overlying or abutting upper surfaces 71 of pin breech teeth 70 as shown in FIG. 2. Upon rotation of locking ring 60 with respect to breech lock base assembly 50 and breech pin 30, as shown in FIG. 3, movable breech teeth 65 overlie or abut upper surfaces 71 of pin breech teeth 70 of breech pin 30, defining a "locked" position of locking ring 60. As there is rotational movement between pin breech teeth 70 and rotatable locking ring 60, breech pin 30 may be secured within breech lock base assembly 50. Movement of breech pin 30 with respect to breech lock base assembly 50, in a direction parallel with longitudinal axes 32, 53 of breech pin 30 and breech lock base assembly 50, defining a longitudinal direction, may be prevented. A longitudinal force applied to breech pin 30 may be transmitted to breech lock base assembly 50 via the engagement between movable breech teeth 65 with upper surfaces 71 of pin breech teeth 70. Thus, a wellhead pressure control equipment component 21, such as a lubricator or wireline blowout preventer, may be secured to wellhead mounted equipment 22, such as a frac tree, via adapter 20.

Figure 4:
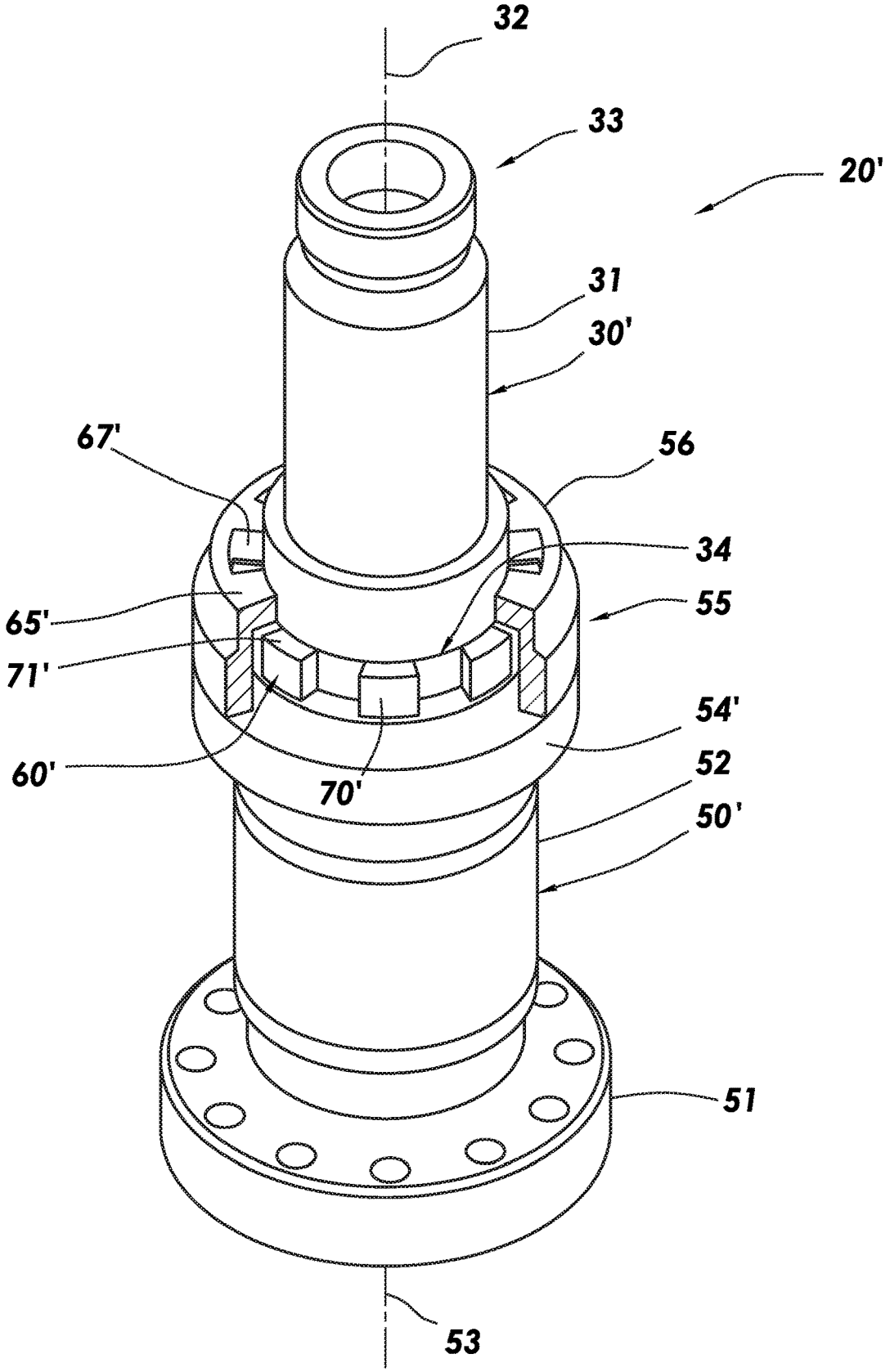
FIG. 4 is a perspective, partial cross-sectional view of an adapter consistent with at least one embodiment of the present disclosure, the adapter being shown in an unlocked configuration.
Figure 5:
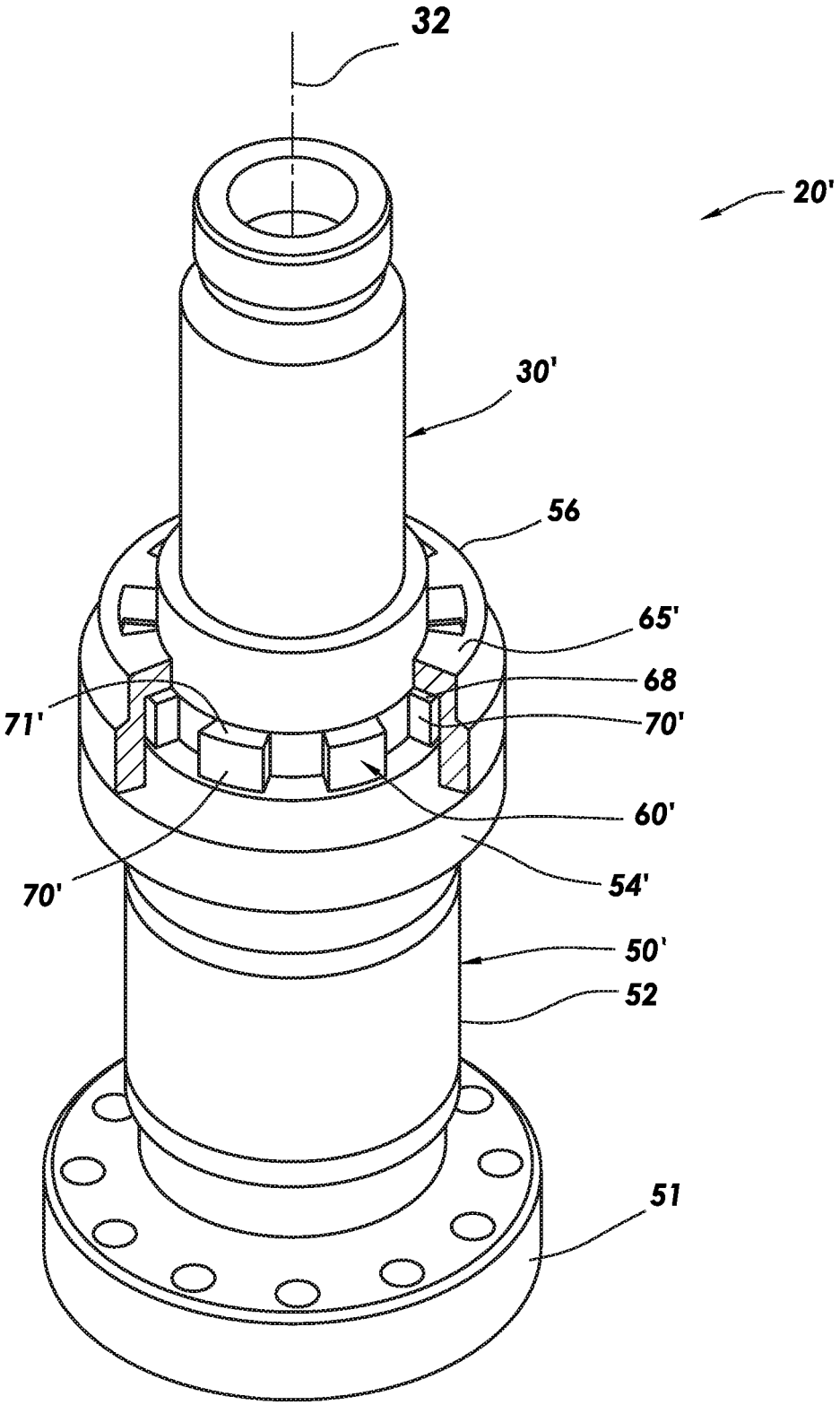
FIG. 5 is a perspective, partial cross-sectional view of the adapter of FIG. 4 in a locked configuration.

In another embodiment, as shown in FIGS. 4 and 5, wellhead adapter 20' may include: breech pin 30'; breech lock base assembly 50'; and rotatable locking ring 60'. Breech pin 30' has longitudinal axis 32, upper end 33, and lower end 34, and breech pin 30 having breech pin body 31. In this embodiment, breech lock base assembly 50' may include annular flange 54', formed integrally with or attached to base assembly body 52. Breech lock base assembly 50 may include longitudinal axis 53 that coincides with longitudinal axis 32 of breech pin 30'. In some embodiments, breech lock base assembly 50' may include an annular shaped housing, defining fixed breech ring 56, secured to upper end 55 of breech lock base assembly body 52. In other embodiments, fixed breech ring 56 may be formed integrally with breech lock base assembly body 52. Fixed breech ring 56 may include one or more fixed breech teeth 65'. In some embodiments, fixed breech teeth 65' may consist of one or more slots 67' in fixed breech ring 56 formed, for example and without limitation, by machining slots 67' from fixed breech ring 56, thus leaving the inwardly extending fixed breech teeth 65' formed on fixed breech ring 56.

Rotatable locking ring 60' may be coupled to breech pin 30' such that rotatable locking ring 60' may rotate relative to both breech pin 30 and breech lock base assembly 50'. As shown in FIG. 4, breech pin 30' is positioned in fixed breech ring 56 of breech lock base assembly 50. Pin breech teeth 70' of rotatable locking ring 60' may pass through slots 67' of fixed breech ring 56 of breech lock base assembly 50. In FIG. 4, rotatable locking ring 60' is shown disposed in an "unlocked" configuration, wherein upper surfaces 71' of pin breech teeth 70' are positioned out of alignment with the lower surfaces of fixed breech teeth 65'. In the unlocked configuration, an upward axial force may be applied to breech pin 30' and breech pin 30' may be pulled away from breech lock base assembly 50' and pin breech teeth 70' to pass through slots 67' of fixed breech ring 56 of breech lock base assembly 50'.

Rotatable locking ring 60' may be rotated with respect to breech pin 30' and breech lock base assembly 50' such that pin breech teeth 70' have been rotated into a "locked" configuration as shown in FIG. 5. In this locked configuration, fixed breech teeth 65' of fixed breech ring 56 of breech lock base assembly 50' at least partially overlie pin breech teeth 70' as shown as overlap 68 in FIG. 5, whereby upper surfaces 71' of pin breech teeth 70 are positioned under the lower surfaces of fixed breech teeth 65'. Thus, movement of breech pin 30' in an upward direction along longitudinal axis 32 of breech pin 30' may be prevented or retarded.

In some embodiments, two or more pin breech teeth 70' may be positioned on rotatable locking ring 60', corresponding to slots 67'. In some embodiments, the number of fixed breech teeth 65' may at least equal the number of pin breech teeth 70' being utilized. Thus, after a wellhead equipment component 21 (FIG. 15) has been secured to upper end 33 of breech pin 30', breech pin 30' may be lowered into fixed breech ring 56 of breech lock base assembly 50' and associated therewith. Wellhead equipment component 21 may be secured to wellhead mounted equipment 22 upon rotating rotatable locking ring 60' into the "locked" position of FIG. 5.

Figure 6:
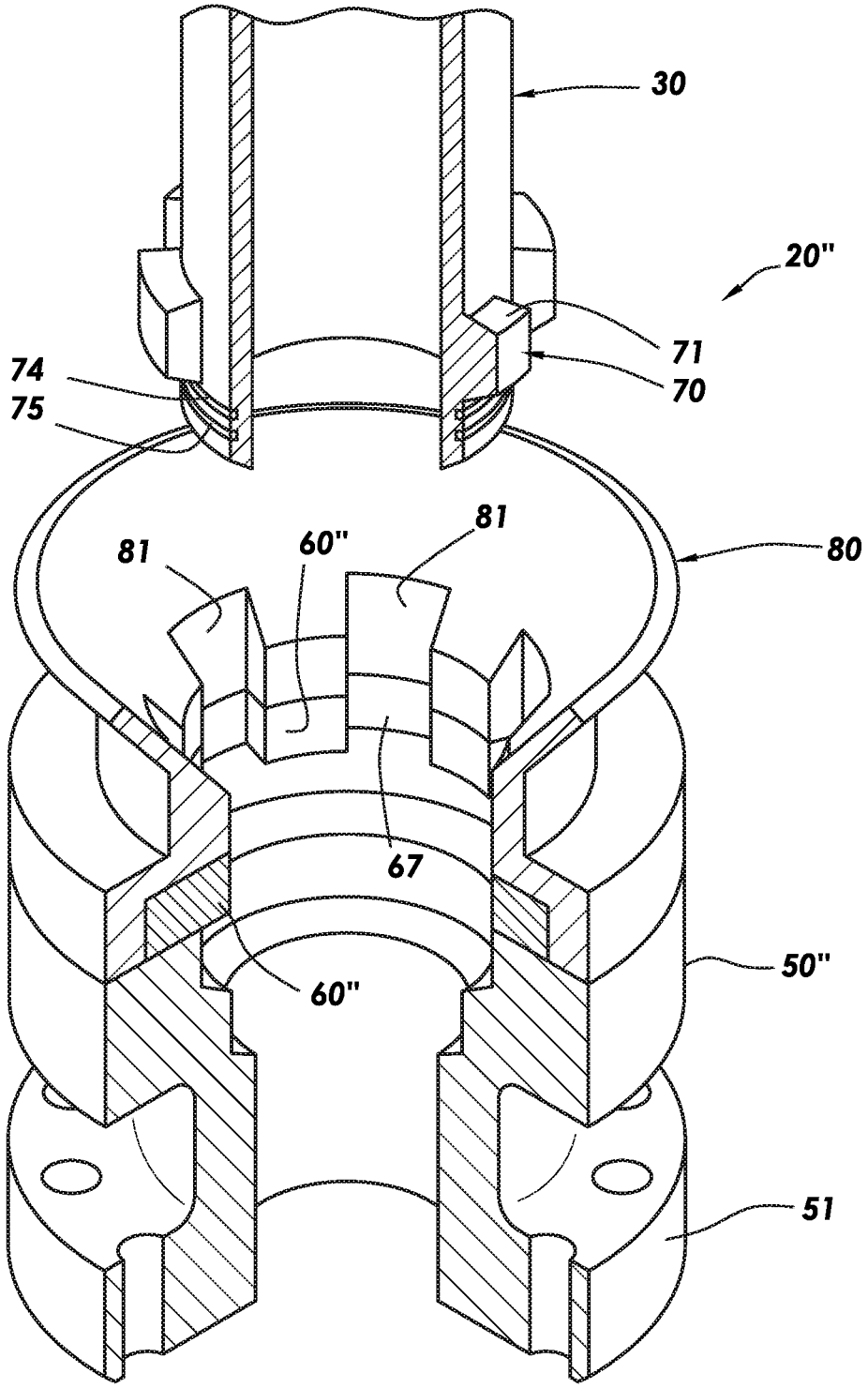
FIG. 6 is a perspective, partial cross-sectional view of an adapter consistent with at least one embodiment of the present disclosure.
Figure 7:
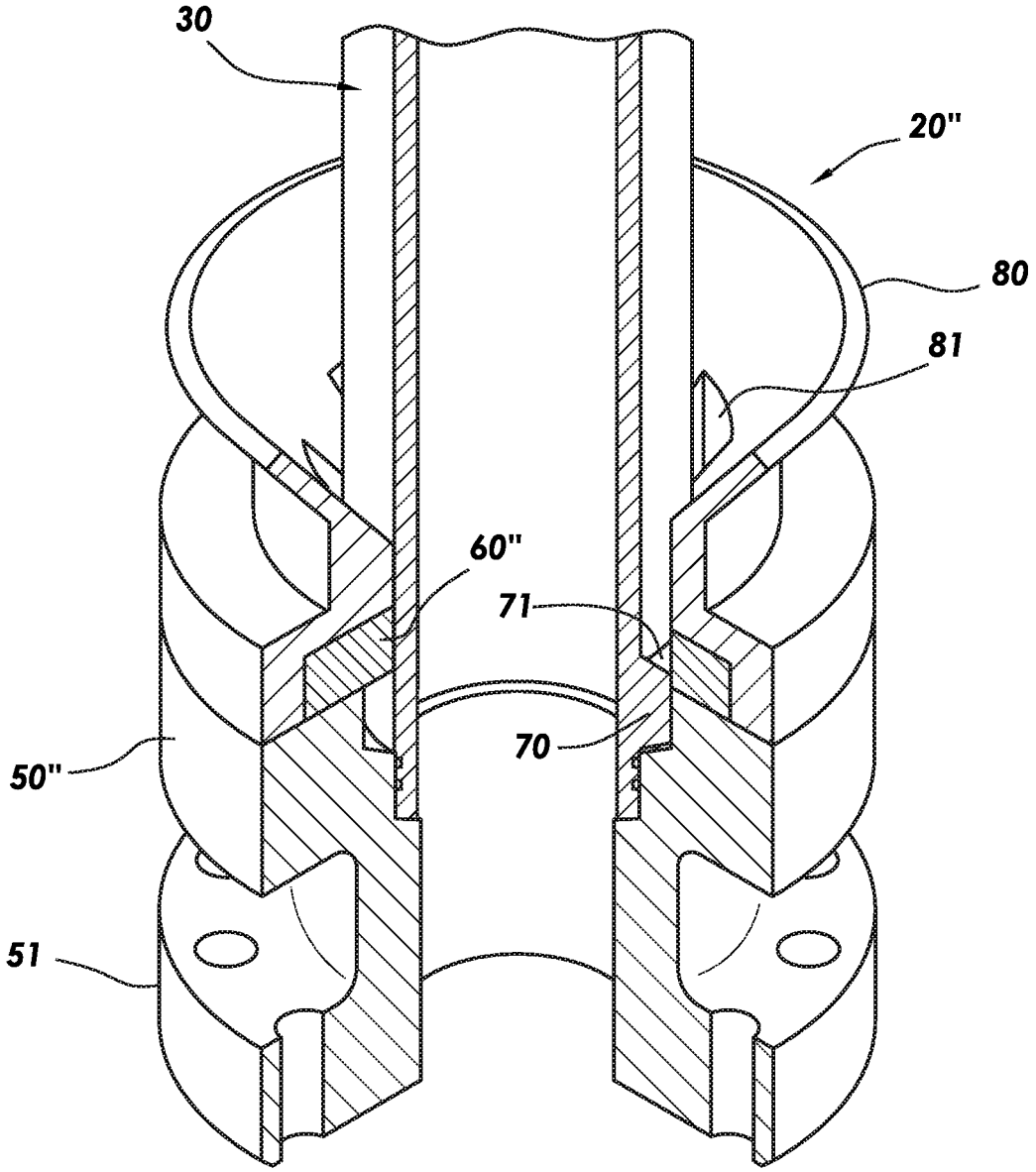
FIG. 7 is a perspective, partial cross-sectional view of the adapter of FIG. 6 in an unlocked configuration.
Figure 8:
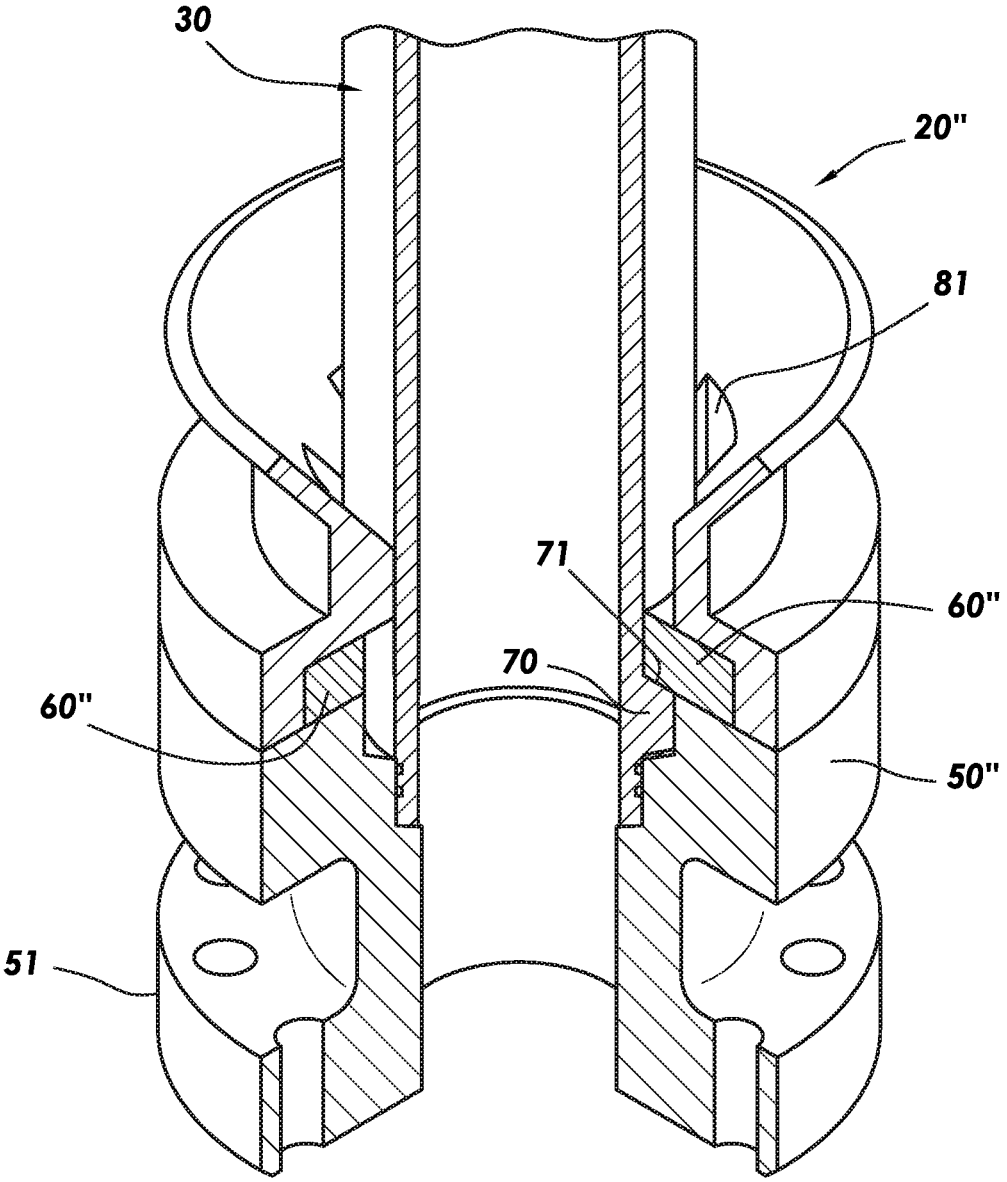
FIG. 8 is a perspective, partial cross-sectional view of the adapter of FIG. 6 in a locked configuration.

In yet another embodiment, adapter 20" of FIGS. 6-8, includes breech lock base assembly 50", rotatable locking ring 60" and breech pin 30. Breech pin 30 may include pin breech teeth 70. Wellhead adapter 20" may include alignment funnel 80, positioned at an upper end of breech lock base assembly 50". In some embodiments, alignment funnel 80 may, for example and without limitation, assist with guiding breech pin 30 into breech lock base assembly 50". In some embodiments, alignment funnel 80 may include slots 81. As breech pin 30 is lowered into breech lock base assembly 50", slots 81 of alignment funnel 80 may correspond with the location of slots 67 of rotatable locking ring 60" when adapter 20" is in the unlocked configuration illustrated in FIGS. 6 and 7. Upon rotation of rotatable locking ring 60" into the locked configuration illustrated in FIG. 8, upper surfaces 71 of pin breech teeth 70 of breech pin 30 may be positioned below the lower surfaces of rotatable locking ring 60", as shown in FIG. 8, whereby upward movement of breech pin 30 with respect to breech lock base assembly 50" may be prevented or retarded. In some embodiments, upper surfaces 71 of pin breech teeth 70 may abut the lower surfaces of rotatable locking ring 60" once adapter 20" is under pressure. The embodiment of adapter 20 of FIGS. 1-3 and wellhead adapter 20' of FIGS. 4-5 may include alignment funnel 80 as shown in FIGS. 6-8.

Figure 9:
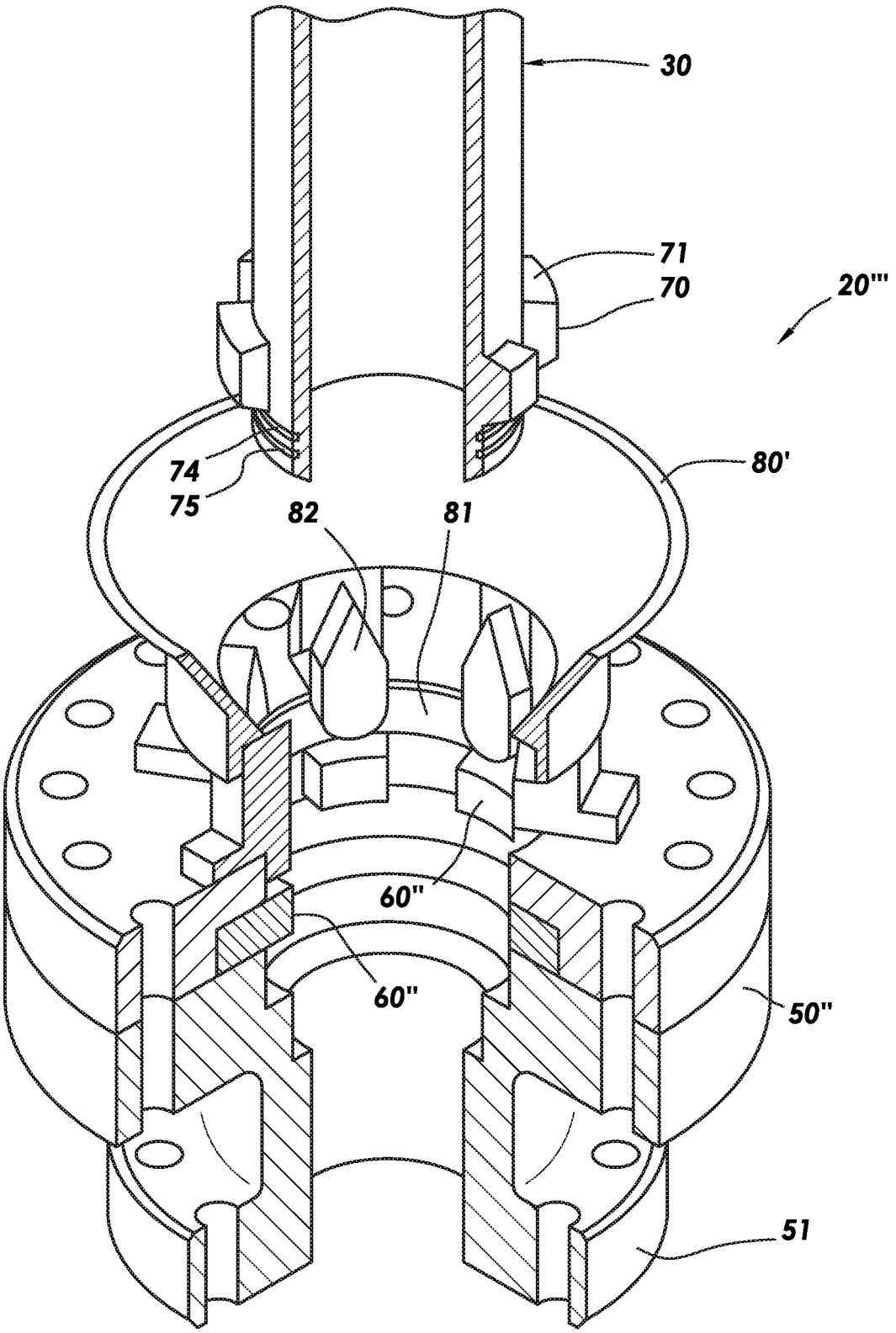
FIG. 9 is a perspective, partial cross-sectional view of an adapter consistent with at least one embodiment of the present disclosure.
Figure 10:
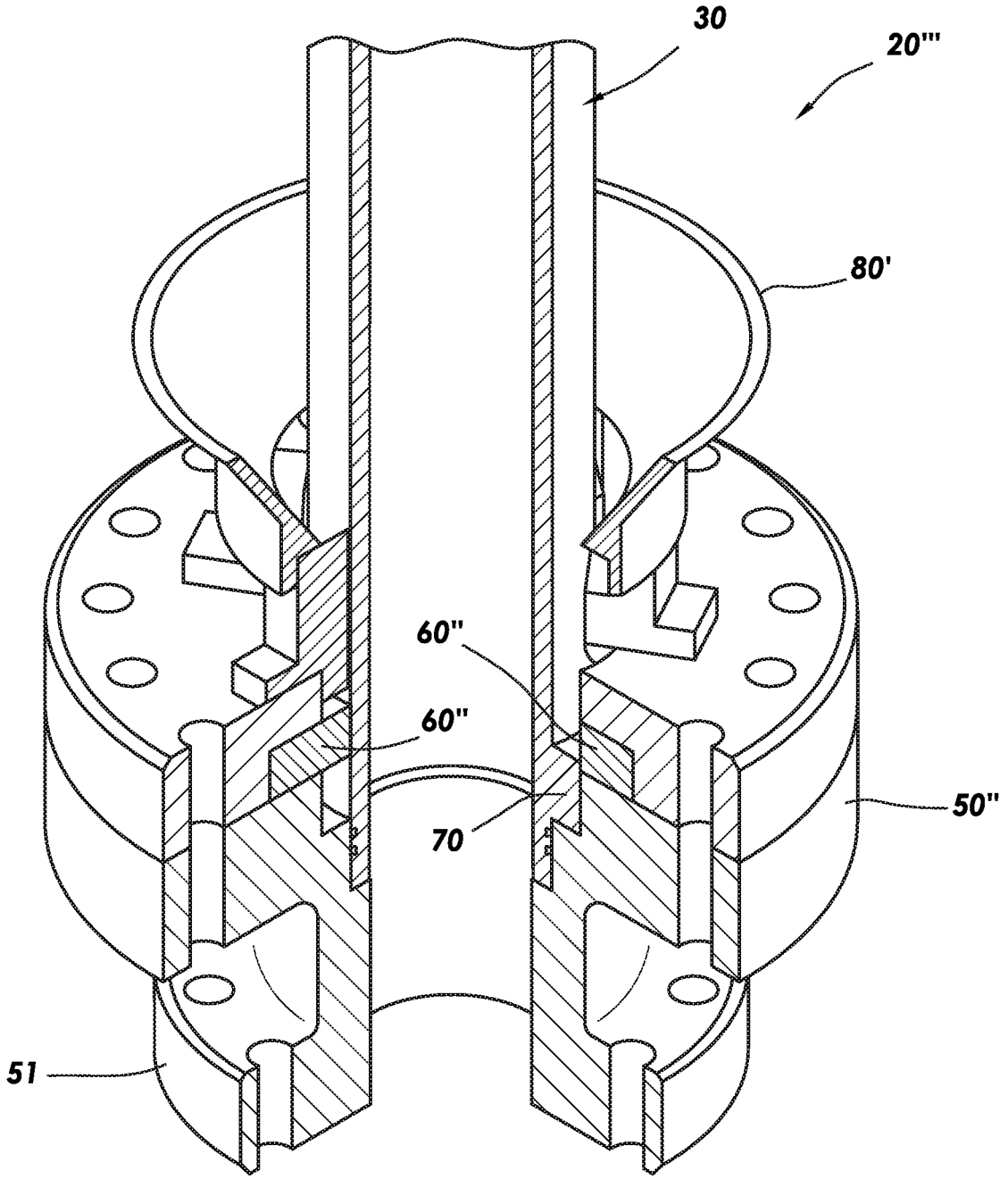
FIG. 10 is a perspective, partial cross-sectional view of the adapter of FIG. 9 in an unlocked configuration.
Figure 11:
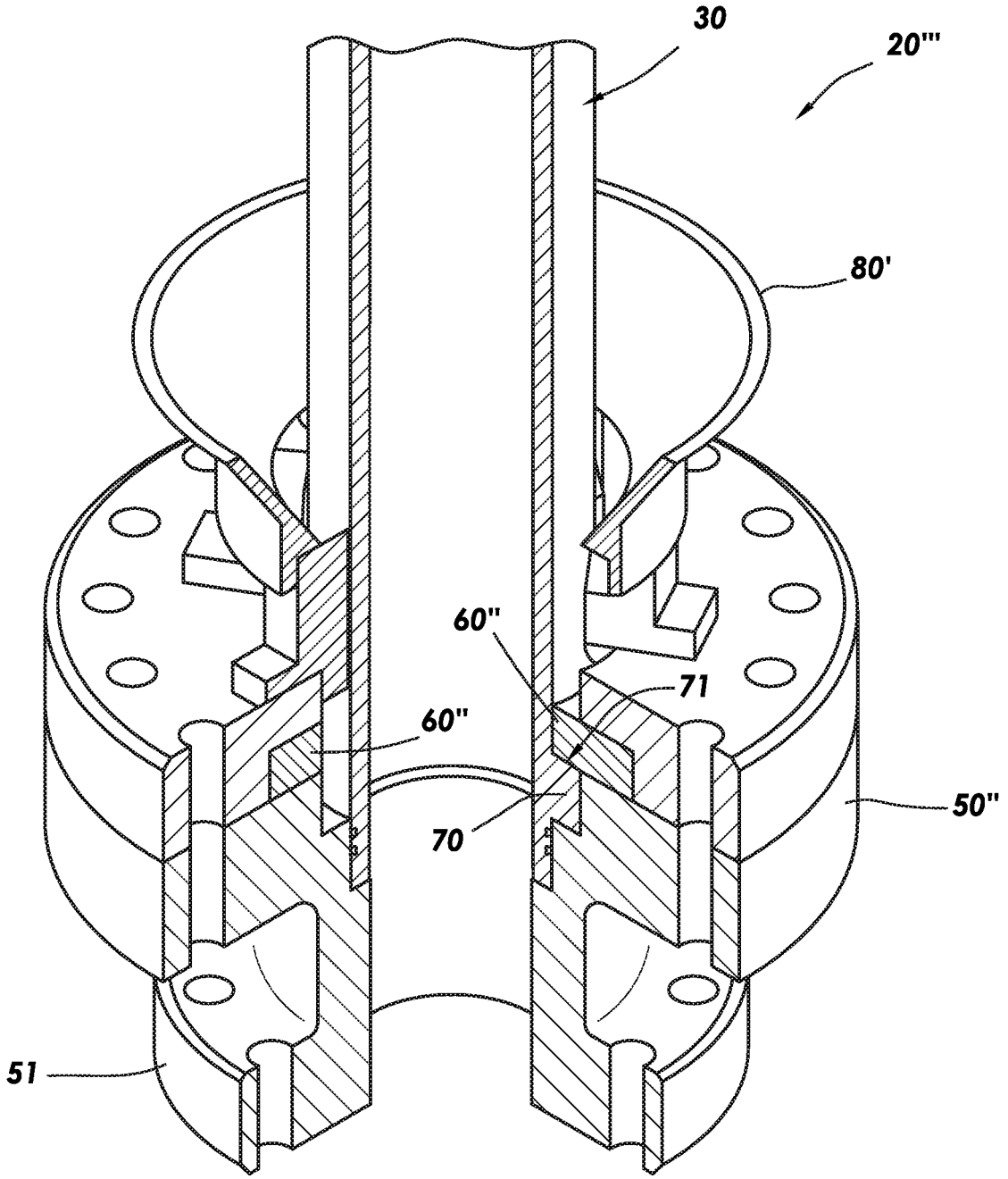
FIG. 11 is a perspective, partial cross-sectional view of the adapter of FIG. 9 in a locked configuration.

In some embodiments, as shown in FIGS. 9-11, adapter 20'" may include alignment funnel 80'. Alignment funnel 80' may include one or more guide members such as tapered alignment teeth 82 positioned to guide pin breech teeth 70 of breech pin 30 through slots 67 of rotatable locking ring 60". Similarly, wellhead adapters 20 and 20" of FIGS. 1-5 may include alignment funnel 80' and tapered alignment teeth 82.

Figure 12:
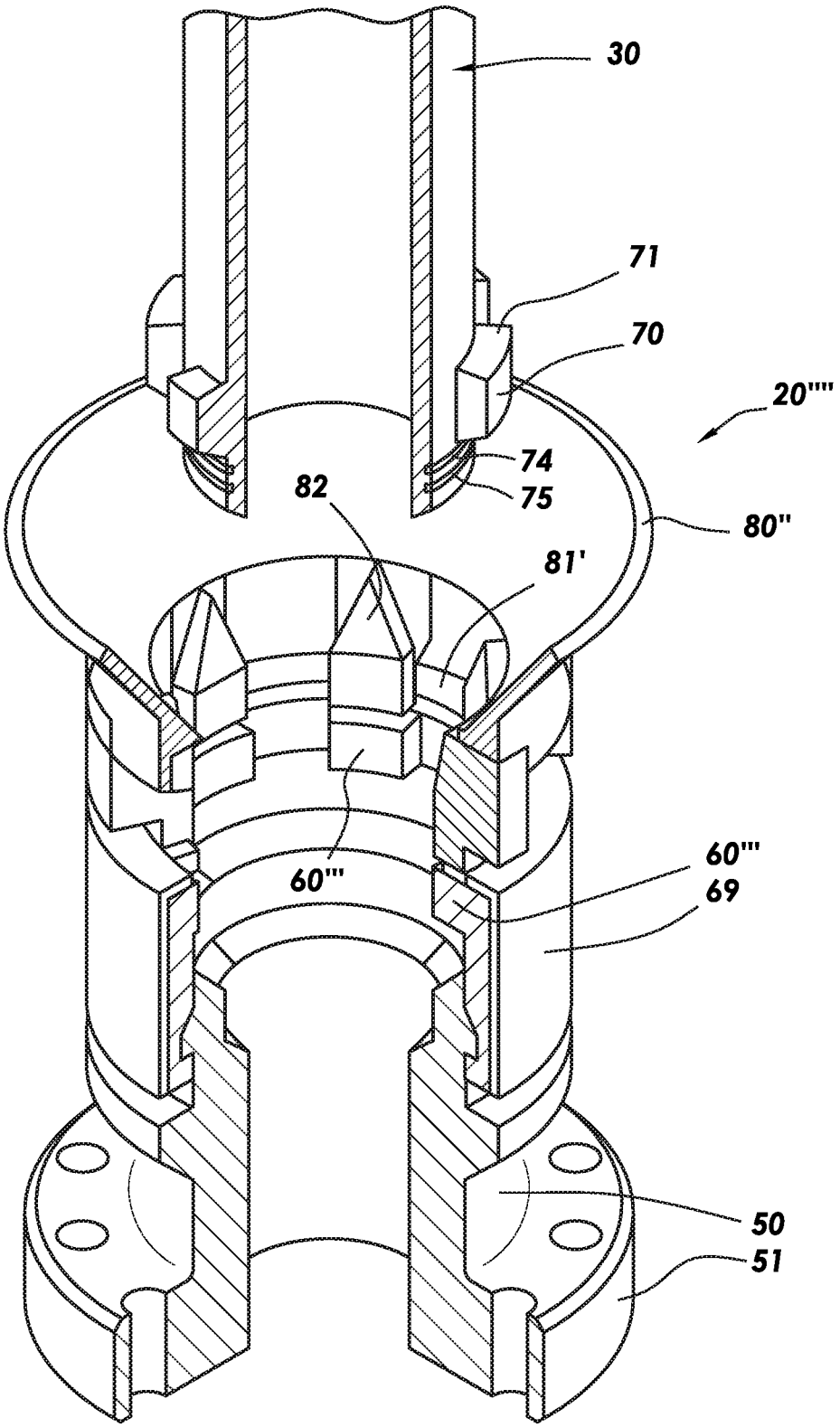
FIG. 12 is a perspective, partial cross-sectional view of an adapter consistent with at least one embodiment of the present disclosure.
Figure 13:
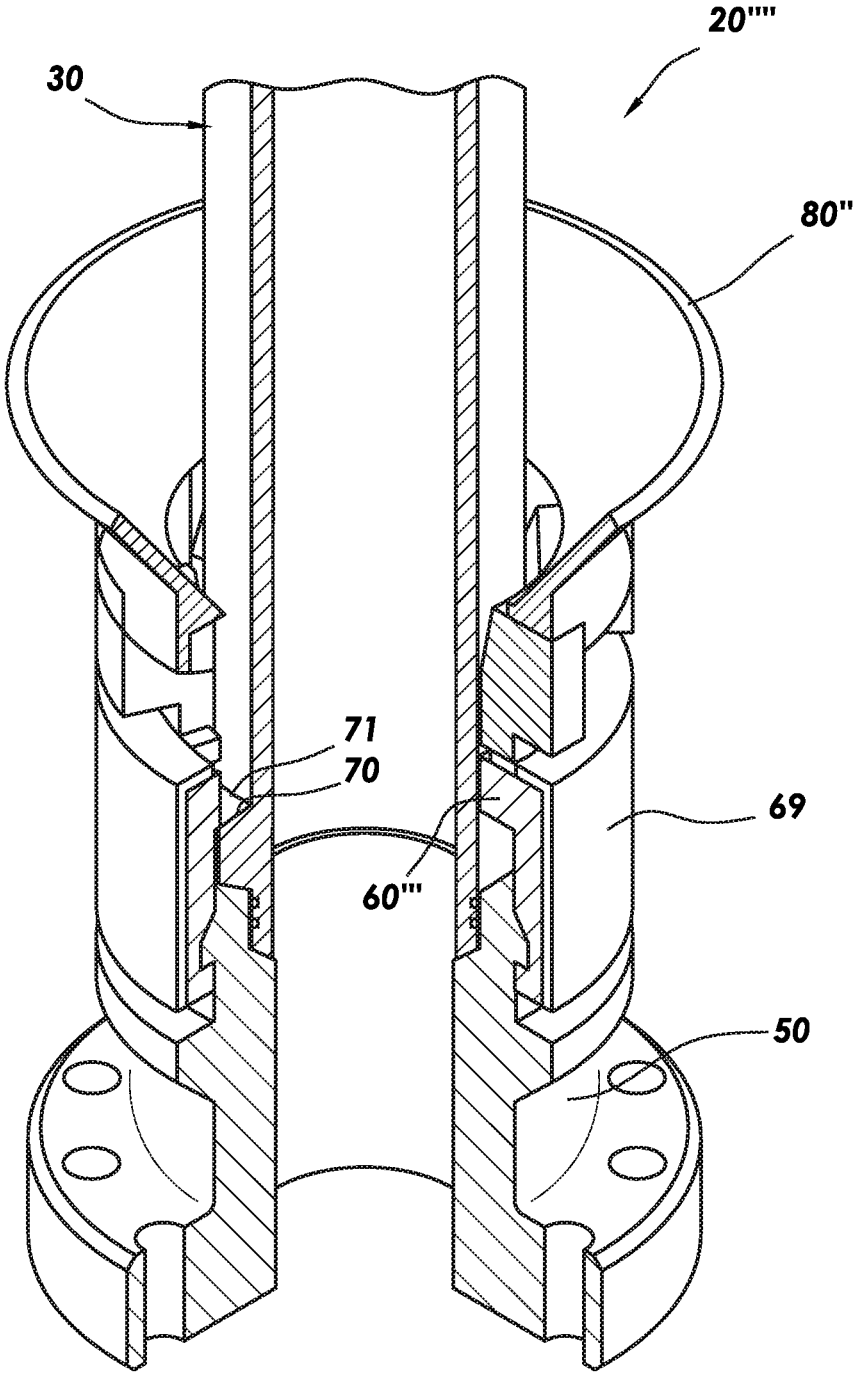
FIG. 13 is a perspective, partial cross-sectional view of the adapter of FIG. 12 in an unlocked configuration.
Figure 14:
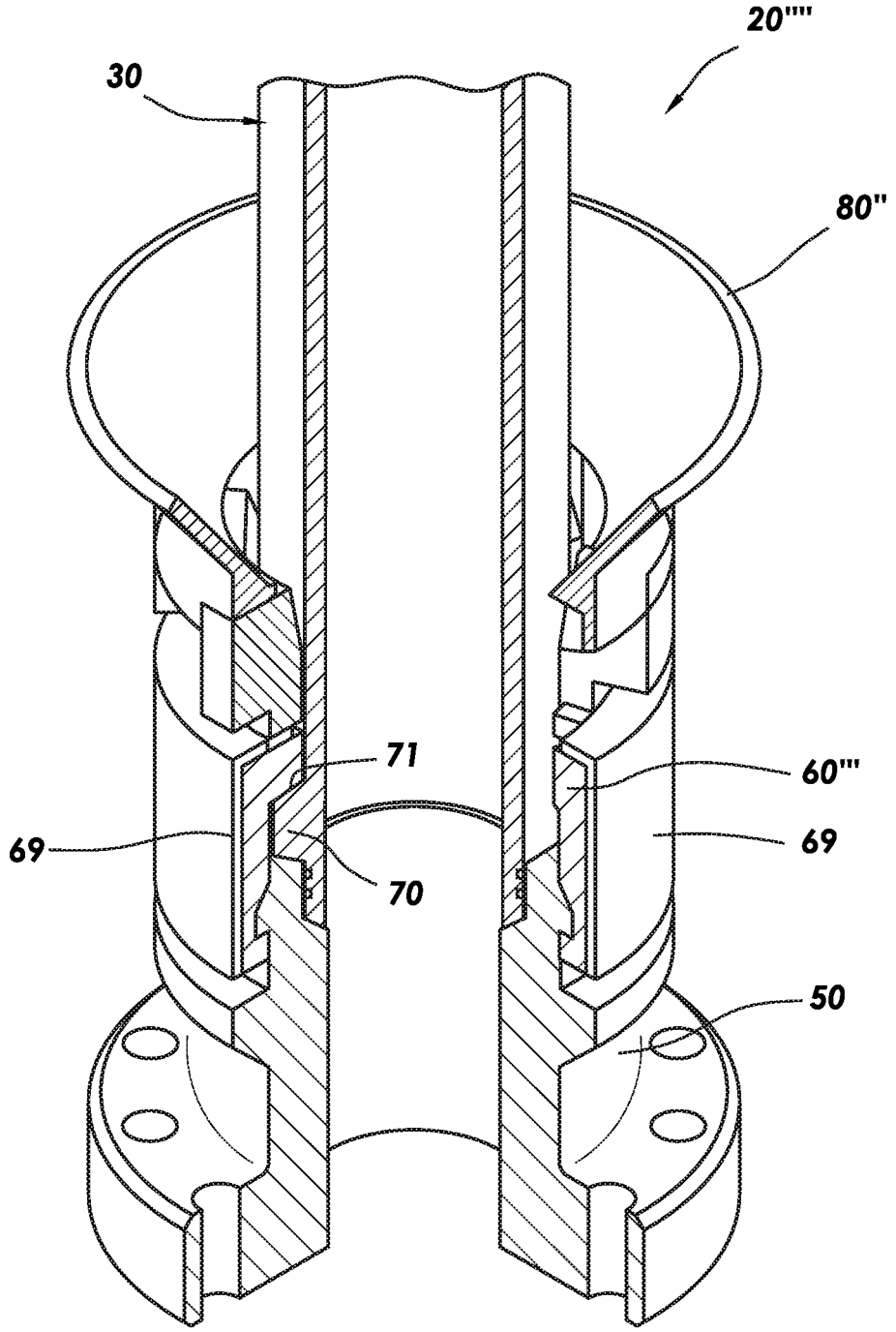
FIG. 14 is a perspective, partial cross-sectional view of the adapter of FIG. 12 in a locked configuration.

In some embodiments, as shown in FIGS. 12-14, adapter 20"" may include alignment funnel 80". Rotatable locking ring 60'" of FIGS. 12-14 may be disposed within an annular housing 69 of breech lock base assembly 50. As shown in FIG. 14, rotatable locking ring 60" may be rotated, whereby rotatable locking ring 60'" abuts upper surfaces 71 of pin breech teeth 70 as shown in FIG. 14.

In some embodiments, the various previously described rotatable locking rings 60, 60', 60", 60'" may be rotated by, for example and without limitation: a rotational to rotational translation in which motion from a rotary actuator is transmitted to the rotatable locking ring, examples of which include gear drives and roller chains and sprockets; or linear to rotational translation in which motion from a linear actuator is transmitted into the rotatable locking ring, examples of which include slider-crank or cam-follower mechanisms and rack and pinion gears. The above gear drives may include, for example and without limitation: parallel shafts, such as, spur gears, internal gears, helical gears, etc.; intersecting shafts, such as, bevel gears, miter gears, etc.; or offset shafts, such as, worm gears, screw gears, etc. The above actuators may be driven, for example and without limitation, by electric, hydraulic, or pneumatic power.

Figure 16:
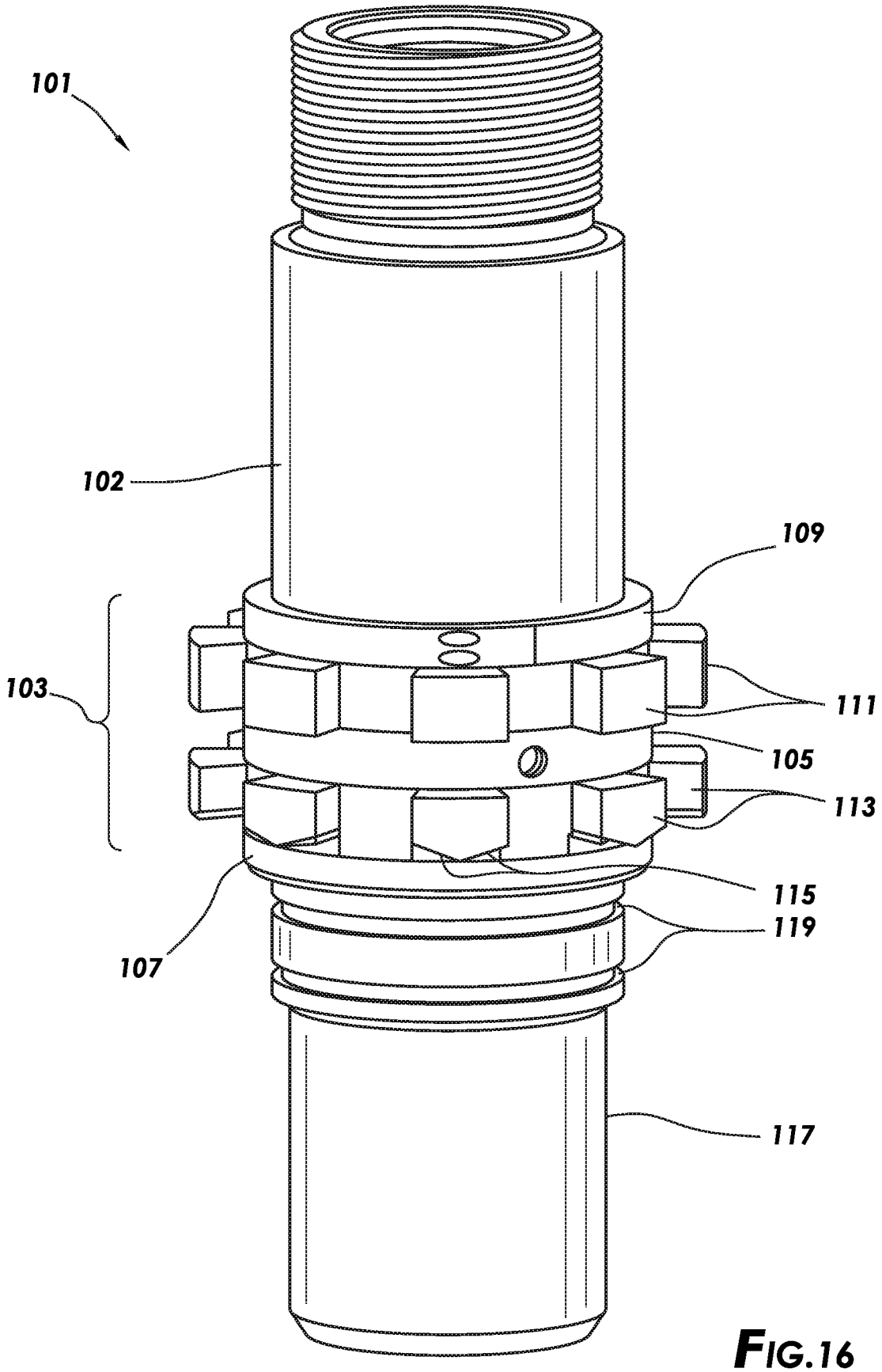
FIG. 16 is a perspective view of a breech pin consistent with at least one embodiment of the present disclosure.

In some embodiments, as shown in FIG. 16, breech pin 101 may include breech pin body 102 and rotating breech ring 103. Rotating breech ring 103 may be coupled to breech pin body 102 such that rotating breech ring 103 may rotate relative to breech pin body 102. Rotating breech ring 103 may include breech ring body 105. Breech ring body 105 may be tubular and may be positioned about breech pin body 102. In some embodiments, breech pin 101 may include lower flange 107 positioned below breech ring body 105 such that flange 107 may support breech ring body 105 from below. In some embodiments, breech ring body 105 may be retained in position on an outer surface of breech pin body 102 by retainer clamp 109. Retainer clamp 109 may be positioned above breech ring body 105 such that lower flange 107 and retainer clamp 109 prevent or retard longitudinal movement of rotating breech ring 103 relative to breech pin body 102.

In some embodiments, rotating breech ring 103 may include upper breech teeth 111 and lower breech teeth 113. Upper breech teeth 111 and lower breech teeth 113 may extend radially outward from breech ring body 105. In some embodiments, lower breech teeth 113 may include lower tapered surface 115 positioned on a lower surface of lower breech teeth 113 which may be used, for example and without limitation, to assist in installation of breech pin 101.

In some embodiments, breech pin 101 may include breech pin nose 117 extending longitudinally below rotating breech ring 103. Breech pin nose 117 may, for example and without limitation, centralize breech pin 101 during installation of breech pin 101 as further described below. In some embodiments, breech pin 101 may include one or more seals 119 positioned on or about breech pin nose 117.

Figure 17:
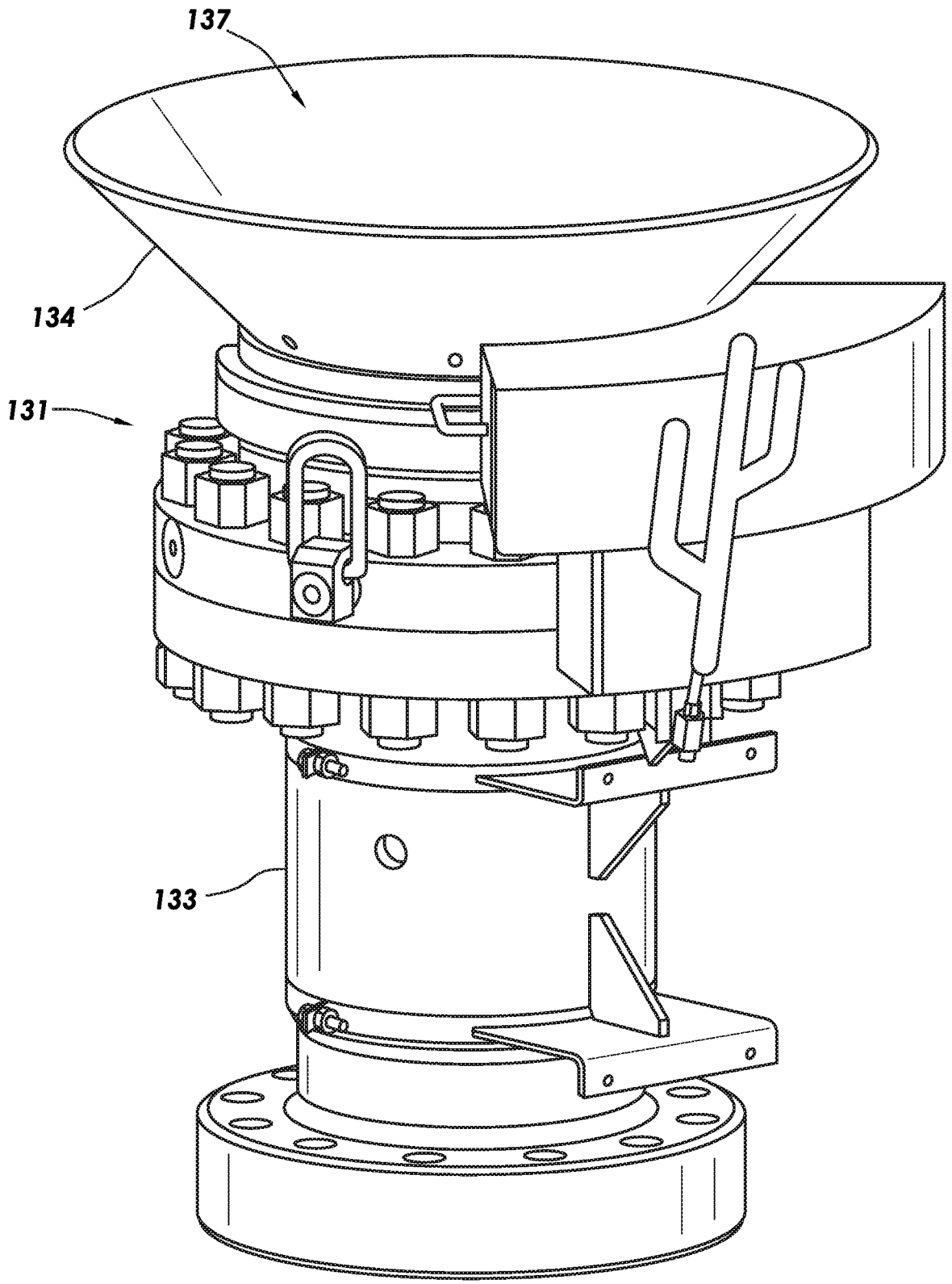
FIG. 17 is a perspective view of a breech lock base assembly consistent with at least one embodiment of the present disclosure.
Figure 18:
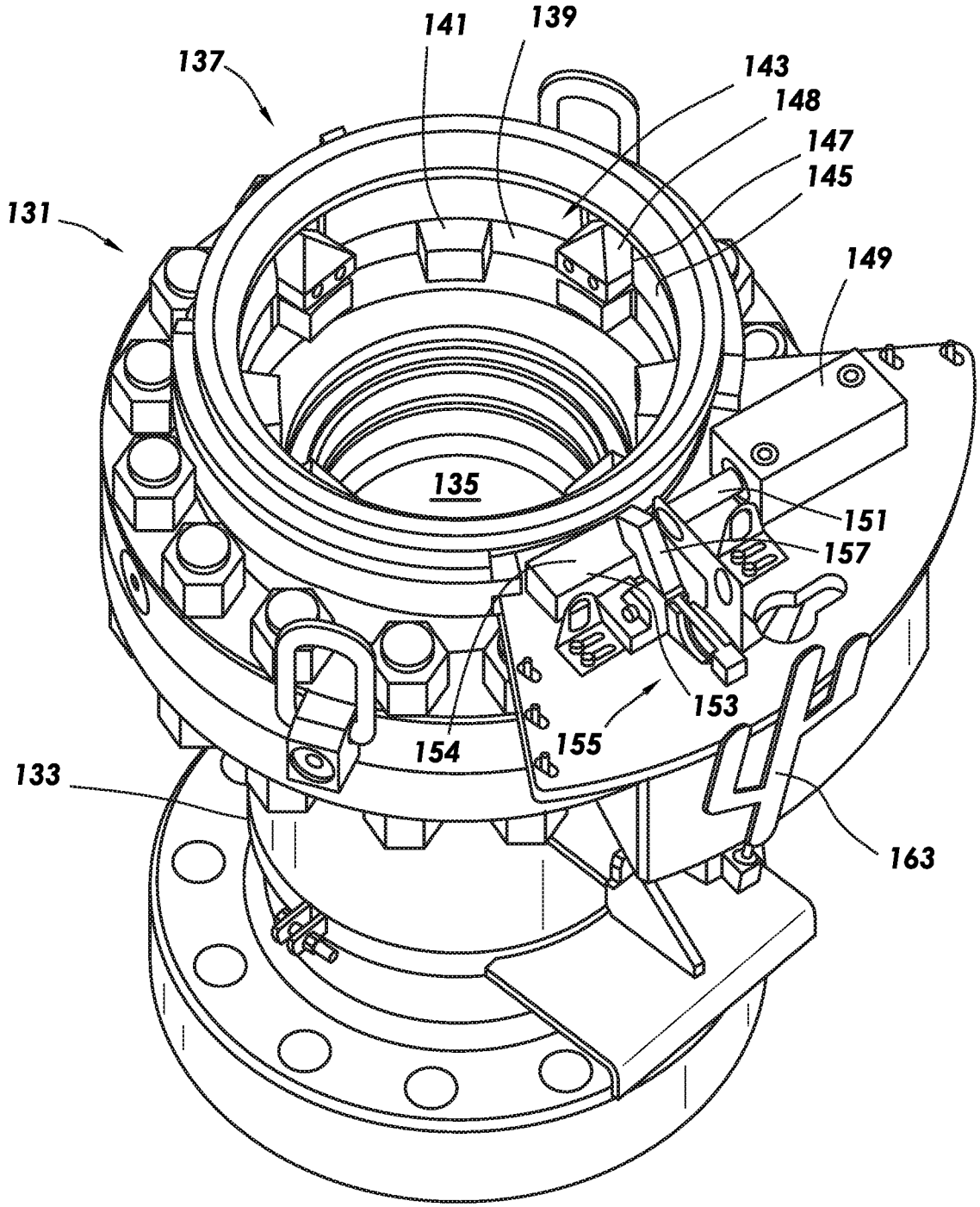
FIG. 18 is a perspective view of a breech lock base assembly consistent with at least one embodiment of the present disclosure in its unlocked configuration.
Figure 19:
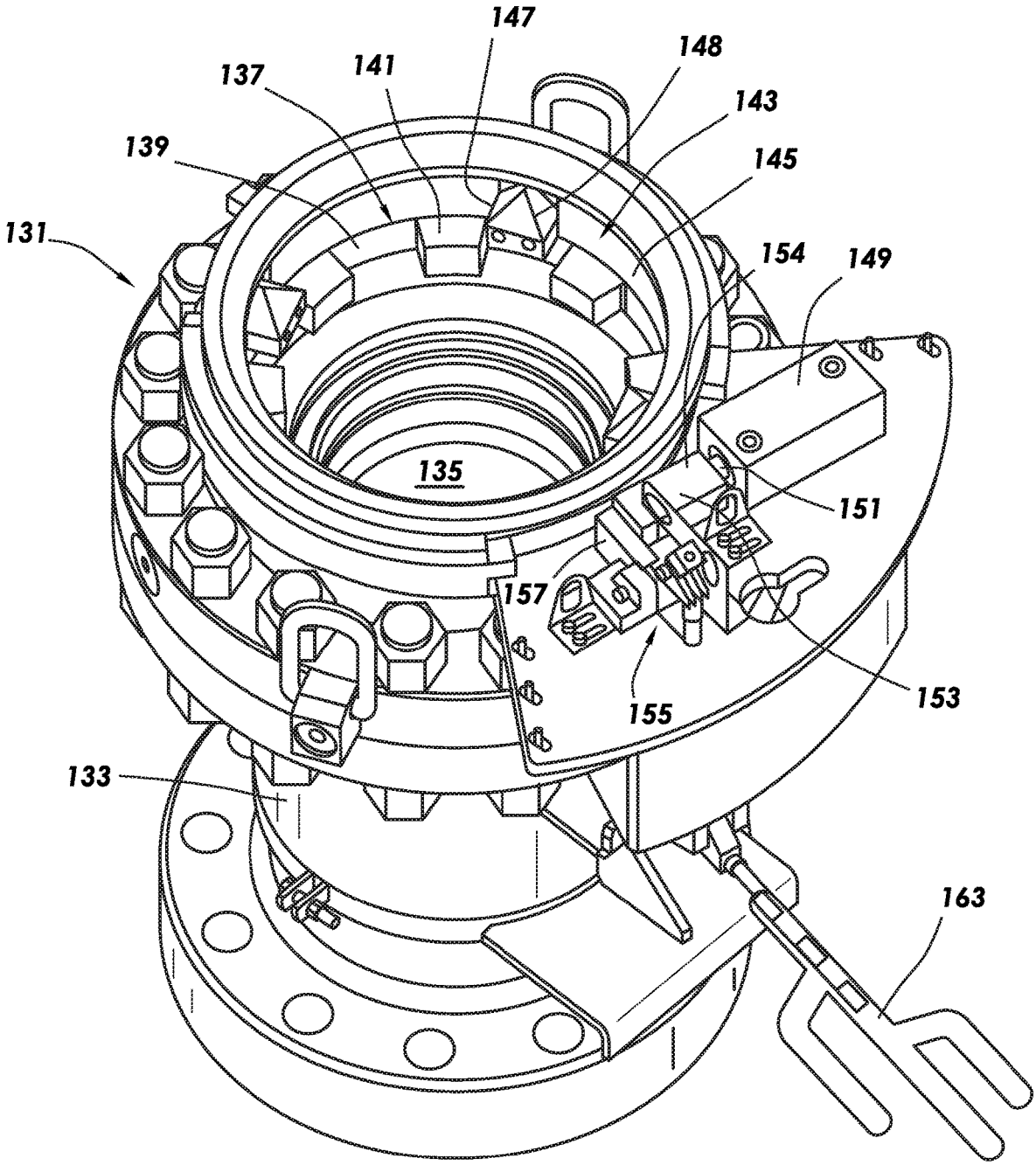
FIG. 19 is a perspective view of the breech lock base assembly of FIG. 18 in its locked position.

In some embodiments, as depicted in FIGS. 17-19, breech lock base assembly 131 may include base assembly body 133. Base assembly body 133 may be tubular and may define inner bore 135. Inner bore 135 may extend longitudinally through base assembly body 133. In some embodiments, base assembly body 133 may define upper receiver 137 adapted to receive breech pin 101 as further discussed below. In some embodiments, as shown in FIG. 17, breech lock base assembly 131 may include alignment funnel 134 positioned at an upper end of base assembly body 133.

In some embodiments, as shown in FIGS. 18 and 19, breech lock base assembly 131 may include fixed retaining ring 139. Fixed retaining ring 139 may be coupled to base assembly body 133 and may include one or more fixed breech teeth 141. Fixed breech teeth 141 may extend radially inward into upper receiver 137.

In some embodiments, breech lock base assembly 131 may include actuating ring 143. Actuating ring 143 may include actuating ring body 145. Actuating ring body 145 may be substantially annular and may be adapted to rotate relative to base assembly body 133. In some embodiments, actuating ring 143 may include one or more movable breech teeth 147. Movable breech teeth 147 may be coupled to actuating ring body 145 and may extend radially inward into upper receiver 137. In some embodiments, movable breech teeth 147 may include tapered upper surface 148 positioned on an upper surface of movable breech teeth 147.

Fixed breech teeth 141 and movable breech teeth 147 may be configured such that fixed breech teeth 141 and movable breech teeth 147 correspond with the sizes and positions of the spaces defined between upper breech teeth 111 and the sizes and positions of the spaces defined between lower breech teeth 113 of breech pin 101. In some embodiments, the number of fixed breech teeth 141 may be the same as the number of lower breech teeth 113 of breech pin 101. In some embodiments, fixed breech teeth 141 and lower breech teeth 113 may be uniformly sized and spaced.

In some embodiments, actuating ring 143 may be movable between a position in which movable breech teeth 147 are aligned with fixed breech teeth 141, defining an "open" position, and a position in which movable breech teeth 147 are not aligned with fixed breech teeth 141, defining a "closed" position. In such an embodiment, actuating ring 143 may move between the open position and the closed position by rotation of actuating ring 143. In some embodiments, when actuating ring 143 is in the open position as depicted in FIG. 18, movable breech teeth 147 may align with fixed breech teeth 141. In some embodiments, when actuating ring 143 is in the closed position as depicted in FIG. 19, movable breech teeth 147 may be aligned with the spaces between fixed breech teeth 141. The degree of rotation of actuating ring 143 required to move between the open position and the closed position may be defined by the number of fixed breech teeth 141 such that the rotation moves movable breech teeth 147 one half of the circumferential distance between fixed breech teeth 141.

In some embodiments, actuating ring 143 may be rotated between the open and closed positions by actuator 149 coupled to base assembly body 133. Actuator 149 may be, for example and without limitation, a linear actuator such as a pneumatic, hydraulic, or electric linear actuator. In some embodiments, actuator 149 may be a rotational actuator coupled to actuating ring 143. In some embodiments, as depicted in FIGS. 18 and 19 wherein actuator 149 is a linear actuator, actuator 149 may include actuation rod 151 coupled to actuation ring 143 by actuation linkage 153. Actuation linkage may translate linear movement of actuation rod 151 into a rotational movement of actuating ring 143 between the open and closed positions.

In some embodiments, breech lock base assembly 131 may include secondary lock assembly 155. Secondary lock assembly 155 may be coupled to base assembly body 133. In some embodiments, secondary lock assembly 155 may include locking bolt 157 positioned to selectively retain actuating ring 143 in the closed position. In some embodiments, locking bolt 157 may extend into a position abutting actuation linkage 153 when actuation ring 143 is in the closed position, defining a "locked" position as shown in FIG. 19. When in the locked position, locking bolt 157 may prevent or retard the movement of actuating ring 143 into the open position by preventing or retarding movement of actuation linkage 153. In some embodiments, locking bolt 157 may be biased into the locked position by, for example and without limitation, a spring or other actuator such as a pneumatic actuator. In some embodiments, locking bolt 157 may be selectively moved away from actuation linkage 153 by unlocking actuator 159 (shown in FIGS. 20 and 21). Unlocking actuator 159 may be selectively used to move locking bolt 157 into a position that does not interfere with the movement of actuation linkage 153, defining an "unlocked" position. In some embodiments, unlocking actuator 159 may couple to locking bolt 157 by unlocking linkage 162 (shown in FIG. 21) through shaft 161 of unlocking actuator 159.

In some embodiments, as shown in FIG. 18, when actuating ring 143 is in the open position, locking bolt 157 may abut top surface 154 of actuation linkage 153, and thereby be held in the unlocked position despite any force biasing locking bolt 157 into the locked position. As actuating ring 143 is moved into the closed position as shown in FIG. 19, actuation linkage 153 may move relative to locking bolt 157 until top surface 154 of actuation linkage 153 is no longer aligned with locking bolt 157, allowing the biasing force to move locking bolt 157 into the locked position.

In some embodiments, secondary lock assembly 155 may include one or more indicators that identify the position of locking bolt 157. For example, in some embodiments, secondary lock assembly 155 may include visual indicator 163. Visual indicator 163 may be coupled to locking bolt 157 and may move between a first position that indicates that locking bolt 157 is in the unlocked position as shown in FIG. 18 and a second position that indicates that locking bolt 157 is in the locked position as shown in FIG. 19. In some embodiments, visual indicator 163 may be pivotably coupled to base assembly body 133 and may be moved between the first position and the second position by unlocking actuator 159. In some embodiments, visual indicator 163 may be a body wherein the appearance of visual indicator 163 in the first position is distinguishable from the appearance of visual indicator 163 in the second position.

In some embodiments, to couple breech pin 101 to breech lock base assembly 131, actuation ring 143 may be positioned into the open position as depicted in FIG. 18. Breech pin 101 may be longitudinally inserted into upper receiver 137. As breech pin 101 enters upper receiver 137, breech pin nose 117 may first enter into inner bore 135 of base assembly body 133. In some such embodiments, breech pin nose 117 may radially align breech pin 101 with inner bore 135 of base assembly body 133. In some embodiments, breech pin nose 117 may engage alignment funnel 134 prior to entering inner bore 135.

In some cases, lower breech teeth 113 may be at least partially aligned with fixed breech teeth 141. Such alignment, for example and without limitation, may otherwise prevent successful insertion of breech pin 101 into upper receiver 137. In some embodiments, as breech pin 101 is received into upper receiver 137, tapered upper surface 148 of movable breech teeth 147 may engage with lower tapered surface 115 of lower breech teeth 113 of rotating breech ring 103. In some embodiments, the movement of breech pin 101 may be translated into a rotation of rotating breech ring 103 due to the geometry of tapered upper surface 148 and lower tapered surface 115 such that lower breech teeth 113 are moved out of alignment with fixed breech teeth 141, or equivalently into alignment with the spaces between fixed breech teeth 141. Such positioning may, for example and without limitation, thereby allow lower breech teeth 113 to pass between fixed breech teeth 141 as breech pin 101 is installed to upper receiver 137.

Figure 20:
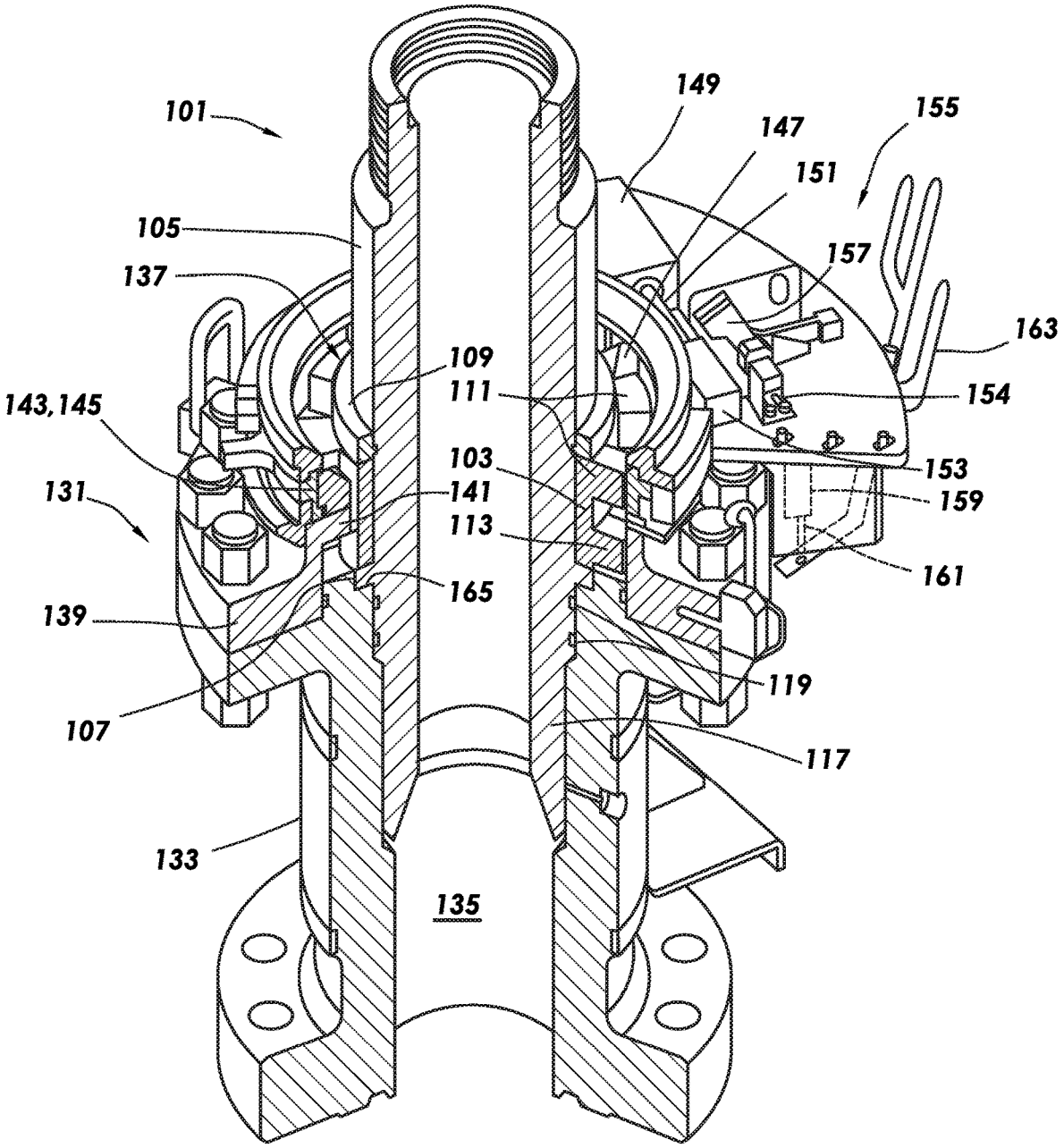
FIG. 20 is a partial cutaway view of a breech pin and breech lock base assembly of FIG. 18.

In some embodiments, once lower breech teeth 113 pass by fixed breech teeth 141 and breech pin 101 is fully installed to upper receiver 137, one or more components of breech pin 101 may engage one or more elements of breech lock base assembly 131, thereby preventing or retarding further longitudinal motion of breech pin 101 when in the position as shown in FIG. 20. For example, in some embodiments, base assembly body 133 may include landing face 165, which may abut lower flange 107 of breech pin 101. In some embodiments, when breech pin 101 is fully inserted into upper receiver 137, seals 119 may seal against an inner surface of base assembly body 133. Although depicted as being positioned on breech pin 101, seals 119 may be positioned on base assembly body 133 without deviating from the scope of this disclosure.

Figure 21:
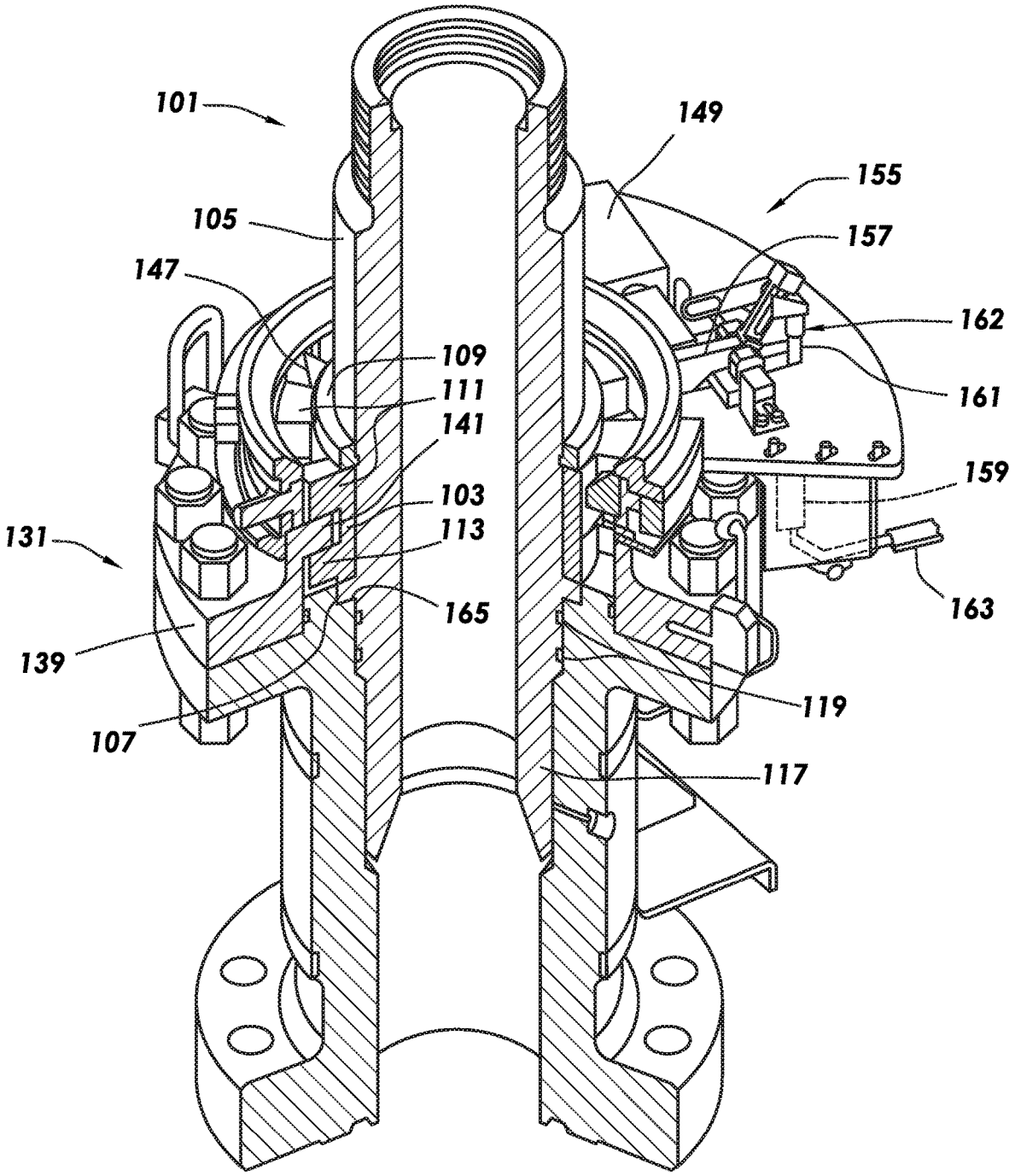
FIG. 21 is a partial cutaway view of the breech pin and breech lock base assembly of FIG. 19.

In some embodiments, when breech pin 101 is installed to upper receiver 137 as shown in FIG. 20, lower breech teeth 113 may be positioned longitudinally below fixed breech teeth 141 and upper breech teeth 111 may be positioned longitudinally above fixed breech teeth 141 and longitudinally aligned with movable breech teeth 147. Actuating ring 143 may then be moved from the open position to the closed position as depicted in FIG. 21. As actuating ring 143 is rotated by actuator 149, movable breech teeth 147 may abut upper breech teeth 111 of breech pin 101 and cause rotation of rotating breech ring 103 relative to breech pin 101. Such rotation of rotating breech ring 103 may move lower breech teeth 113 into rotational alignment with fixed breech teeth 141. Such alignment may retain breech pin 101 within upper receiver 137 and thereby prevent breech pin 101 from being longitudinally removed from breech lock base assembly 131.

In some embodiments, once actuating ring 143 is in the closed position, locking bolt 157 may move into the locked position. Locking bolt 157 may retain actuating ring 143 in the closed position as discussed above and may thereby prevent rotation of rotating breech ring 103. Lower breech teeth 113 may thus remain in rotational alignment with fixed breech teeth 141. Because locking bolt 157 is biased to the locked position, breech pin 101 may remain in the locked position despite a loss of power or control over actuating ring 143 as locking bolt 157 remains in the locked position.

To remove breech pin 101 from breech lock base assembly 131, locking bolt 157 may be translated to the unlocked position using unlocking actuator 159. Actuator 149 may rotate actuating ring 143 from the closed position to the open position as shown in FIG. 20. As actuating ring 143 moves to the open position, movable breech teeth 147 may abut upper breech teeth 111 of breech pin 101 and may cause rotation of rotating breech ring 103 relative to breech pin 101. Such rotation of rotating breech ring 103 may move lower breech teeth 113 out of rotational alignment with fixed breech teeth 141 or, equivalently, into rotational alignment with the spaces between fixed breech teeth 141. Such alignment may allow for longitudinal movement between breech pin 101 and breech lock base assembly 131. Breech pin 101 may be longitudinally withdrawn from upper receiver 137 of breech lock base assembly 131.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invetion claimed is:

1. An adapter for coupling wellhead pressure control equipment to wellhead mounted equipment, comprising:

a breech pin, the breech pin including:

a breech pin body; and a rotating breech ring, the rotating breech ring coupled to the breech pin body and rotatable relative to the breech pin body, the rotating breech ring including a breech ring body and one or more breech pin teeth extending radially outward from the breech ring body;

a breech lock base assembly, the breech lock base assembly including;

a base assembly body, the base assembly body including a bore, an upper end of the bore of the base assembly body defining an upper receiver, a fixed retaining ring, the fixed retaining ring including one or more fixed breech teeth, the fixed breech teeth extending radially inward into the upper receiver, the fixed breech teeth positioned to correspond with spaces between the breech pin teeth, wherein the number of fixed breech teeth is equal to or greater than the number of breech pin teeth; and an alignment funnel positioned at the upper end and configured to guide the breech pin into the breech lock base assembly.

2. The adapter of claim 1, wherein the breech lock base assembly further comprises an actuating ring, the actuating ring mechanically coupled to the base assembly body such that the actuating ring is rotatable relative to the breech lock base assembly, the actuating ring including an actuating ring body and one or more movable breech teeth coupled to the actuating ring body, the movable breech teeth extending radially inward into the upper receiver, the movable breech teeth positioned to correspond with the positions of one or more of the the fixed breech teeth, wherein the movable breech teeth each include a tapered upper surface.

3. The adapter of claim 2, wherein the actuating ring is adapted to move between an open position in which each of the movable breech teeth rotationally align with the fixed breech teeth and a closed position in which each of the movable breech teeth align with the spaces between the fixed breech teeth.

4. The adapter of claim 3, wherein the actuating ring is mechanically coupled to an actuator, the actuator adapted to move the actuating ring between the open position and the closed position.

5. The adapter of claim 4, wherein the actuating ring is mechanically coupled to the actuator by an actuation linkage.

6. The adapter of claim 4, further comprising a secondary lock assembly, the secondary lock assembly comprising a locking bolt, the locking bolt adapted to move between a locked position and an unlocked position.

7. The adapter of claim 6, wherein the locking bolt is biased into the locked position.

8. The adapter of claim 6, further comprising an unlocking actuator, the unlocking actuator coupled to the locking bolt and adapted to move the locking bolt from the locked position to the unlocked position.

9. The adapter of claim 6, further comprising a visual indicator, the visual indicator coupled to the locking bolt.

10. The adapter of claim 2, wherein the breech pin teeth of the rotating breech ring comprise one or more upper breech teeth and one or more lower breech teeth, the upper breech teeth spaced longitudinally apart along the rotating breech ring from the lower breech teeth, the upper and lower breech teeth positioned to correspond with the positions of the fixed breech teeth, wherein the upper breech teeth align longitudinally with the movable breech teeth when the breech pin is installed to the breech lock base assembly, wherein the lower breech teeth each include a tapered lower surface.

11. The adapter of claim 1, wherein the breech pin further comprises a breech pin nose, the breech pin nose coupled to or formed integrally with the breech pin body and extending beyond the rotating breech ring.

12. The adapter of claim 11, wherein the breech pin body further comprises one or more seals positioned to sealingly engage with the base assembly body, the breech pin nose extending beyond the rotating breech ring such that the seals do not contact the fixed breech teeth as the breech pin body is inserted into the base assembly body.

13. The adapter of claim 1 wherein the alignment funnel includes a plurality of alignment teeth, the alignment teeth corresponding in number and rotational position to the fixed breech teeth, and wherein the alignment teeth are configured to guide the breech pin teeth between the fixed breech teeth.

14. The adapter of claim 13 wherein the alignment teeth each include a tapered upper surface.

15. A method comprising:

providing a breech pin, the breech pin including:

a breech pin body, the breech pin body being tubular; and a rotating breech ring, the rotating breech ring coupled to the breech pin body, the rotating breech ring including a breech ring body and one or more breech pin teeth extending radially outward from the breech ring body;

coupling a breech lock base assembly to a wellhead, the breech lock base assembly including:

a base assembly body, the base assembly body including a bore, the base assembly body being tubular, an upper end of the bore of the base assembly body defining an upper receiver, a fixed retaining ring, the fixed retaining ring including one or more fixed breech teeth, the fixed breech teeth extending radially inward into the upper receiver, the fixed breech teeth positioned to correspond with spaces between the breech pin teeth, wherein the number of fixed breech teeth is equal to or greater than the number of breech pin teeth; and an alignment funnel positioned at the upper end and configured to guide the breech pin teeth between the fixed breech teeth;

aligning the breech pin teeth with the spaces between the fixed breech teeth;

inserting the breech pin into the upper receiver; and rotating the rotating breech ring such that one or more of the breech pin teeth are positioned below and aligned with the fixed breech teeth.

16. The method of claim 15, wherein:

the breech lock base assembly further comprises an actuating ring, the actuating ring mechanically coupled to the base assembly body such that the actuating ring is rotatable relative to the breech lock base assembly, the actuating ring including an actuating ring body and one or more movable breech teeth coupled to the actuating ring body, the movable breech teeth extending radially inward into the upper receiver, the movable breech teeth positioned to correspond with the positions of one or more of the fixed breech teeth, wherein the movable breech teeth each include a tapered upper surface; and the breech pin teeth of the rotating breech ring comprise one or more upper breech teeth and one or more lower breech teeth, the upper breech teeth spaced longitudinally apart along the rotating breech ring from the lower breech teeth, the upper and lower breech teeth positioned to correspond with the positions of the fixed breech teeth, wherein the upper breech teeth align longitudinally with the movable breech teeth when the breech pin is installed to the breech lock base assembly, and wherein the lower breech teeth each include a tapered lower surface;

wherein rotating the rotating breech ring comprises:

engaging the upper breech teeth with the movable breech teeth;

rotating the actuating ring from an open position to a closed position; and rotating the breech ring such that one or more of the lower breech teeth are positioned below the fixed breech teeth.

17. The method of claim 16, wherein the actuating ring is mechanically coupled to an actuator, the actuator used to move the actuating ring between the open position and the closed position.

18. The method of claim 17, wherein the breech lock base assembly further comprises a secondary lock assembly, the secondary lock assembly including a locking bolt, the locking bolt adapted to move between a locked position and an unlocked position;

wherein the method further comprises moving the locking bolt into the locked position after the actuating ring is in the closed position; and preventing rotation of the actuating ring to the open position with the locking bolt.

19. The method of claim 18, wherein the locking bolt is biased into the locked position.

20. An adapter for coupling wellhead pressure control equipment to wellhead mounted equipment, comprising:

a breech pin, the breech pin including:

a breech pin body; and a rotating breech ring, the rotating breech ring coupled to the breech pin body and rotatable relative to the breech pin body, the rotating breech ring including a breech ring body and one or more breech pin teeth extending radially outward from the breech ring body, the breech pin teeth comprising one or more upper breech teeth and one or more lower breech teeth, wherein the lower breech teeth each include a tapered lower surface;

a breech lock base assembly, the breech lock base assembly including:

a base assembly body, the base assembly body including a bore, an upper end of the bore of the base assembly body defining an upper receiver;

a fixed retaining ring, the fixed retaining ring including one or more fixed breech teeth, the fixed breech teeth extending radially inward into the upper receiver, the fixed breech teeth positioned to correspond with spaces between the breech pin teeth;

an actuating ring, the actuating ring mechanically coupled to the base assembly body and rotatable relative to the breech lock base assembly, the actuating ring including an actuating ring body and one or more movable breech teeth coupled to the actuating ring body, the movable breech teeth extending radially inward into the upper receiver and each including a tapered upper surface, wherein the movable breech teeth align longitudinally with the upper breech teeth when the breech pin is installed to the breech lock base assembly; and an alignment funnel configured to guide the breech pin into the breech lock base assembly, wherein the alignment funnel includes a plurality of alignment teeth configured to guide the breech pin teeth between the fixed breech teeth;

wherein the breech pin body comprises one or more seals positioned to sealingly engage with the base assembly body.

* * * * *